US009361760B1

(12) United States Patent
Chen

(10) Patent No.: US 9,361,760 B1
(45) Date of Patent: Jun. 7, 2016

(54) RACE GAME ALLOWING SELECTABLE TRACK LENGTHS, RUN SCHEDULES AND PAYOFFS

(71) Applicant: Yi Chen, Los Angeles, CA (US)

(72) Inventor: Yi Chen, Los Angeles, CA (US)

( * ) Notice: Subject to any disclaimer, the term of this patent is extended or adjusted under 35 U.S.C. 154(b) by 0 days.

(21) Appl. No.: 14/544,291

(22) Filed: Dec. 19, 2014

(51) Int. Cl.
*G07F 17/32* (2006.01)

(52) U.S. Cl.
CPC ..... *G07F 17/3288* (2013.01); *G07F 17/3244* (2013.01)

(58) Field of Classification Search
None
See application file for complete search history.

(56) References Cited

U.S. PATENT DOCUMENTS

| | | | | |
|---|---|---|---|---|
| 3,463,496 | A | 8/1969 | Weinstein et al. | |
| 3,560,127 | A | 2/1971 | Imperato | |
| 4,844,462 | A | 7/1989 | Lubniewski | |
| 5,156,397 | A | 10/1992 | Valenza | |
| 5,186,460 | A | 2/1993 | Fongeallaz et al. | |
| 5,795,226 | A | 8/1998 | Yi | |
| 6,152,822 | A | 11/2000 | Herbert | |
| 6,394,898 | B1 * | 5/2002 | Nagao | A63F 9/143 273/246 |
| 6,793,575 | B2 | 9/2004 | Brown et al. | |
| 6,834,856 | B2 * | 12/2004 | Wilson | A63F 3/00082 273/236 |
| 6,921,331 | B2 * | 7/2005 | Gatto | G06Q 50/34 273/138.1 |
| 7,172,506 | B2 | 2/2007 | Baerlocher et al. | |
| 7,294,054 | B2 * | 11/2007 | Schugar | G07F 17/32 463/6 |
| 7,306,514 | B2 * | 12/2007 | Amaitis | G07F 17/32 273/237 |
| 8,062,114 | B2 | 11/2011 | Bennett | |
| 8,142,269 | B2 | 3/2012 | Tsukahara | |
| 8,192,264 | B2 | 6/2012 | Okada | |
| 8,672,746 | B2 | 3/2014 | Burford | |
| 8,758,109 | B2 | 6/2014 | Lutnick | |
| 2004/0204216 | A1 | 10/2004 | Schugar | |
| 2005/0176495 | A1 | 8/2005 | Stronach | |
| 2009/0011812 | A1 | 1/2009 | Katz et al. | |
| 2010/0130277 | A1 | 5/2010 | Miller et al. | |
| 2011/0287822 | A1 | 11/2011 | Walker et al. | |

* cited by examiner

*Primary Examiner* — Sunit Pandya

(57) ABSTRACT

A method to operate simultaneous races providing race-courses (10) printed on bet slips and scheduling draws of random numbers for racer advancements. On a bet slip, the player marks one selectable spot for a racer to start and none to scratch a racer, and also selects which forthcoming draws will be applicable to advance racers. Make-up bets can be placed between advancements. Besides, a 1-race bet winner can earn cash payoff or non-cashable credit to wager like cash. The ticket holder of a hanging multi-race bet has the option to trade in hanging credit for placing other bets. How to calculate advancement probabilities, winner credits, hanging credits and specific house edge formulas for payoffs will be provided. An automatic computer/video version of the game is included.

7 Claims, 17 Drawing Sheets

Draw #114
#1: 4 #2: 2 #3: 1 #4: 3 #5: 2 #6: 5 #7: 4 #8: 2 #9: 5

Draw #115
#1: 3 #2: 4 #3: 3 #4: 2 #5: 2 #6: 6 #7: 4 #8: 3 #9: 6

Draw #116
#1: 6 #2: 5 #3: 2 #4: 3 #5: 2 #6: 4 #7: 3 #8: 2 #9: 4

Draw #117
#1: 1 #2: 3 #3: 1 #4: 3 #5: 4 #6: 4 #7: 2 #8: 1 #9: 5

Win / Place / Show
Credit
Bet before 2nd advancement
Total bets: 15
Total amount: $30.00
Race starts at Draw #17
2nd advancement at Draw #27
3rd advancement at Draw #37

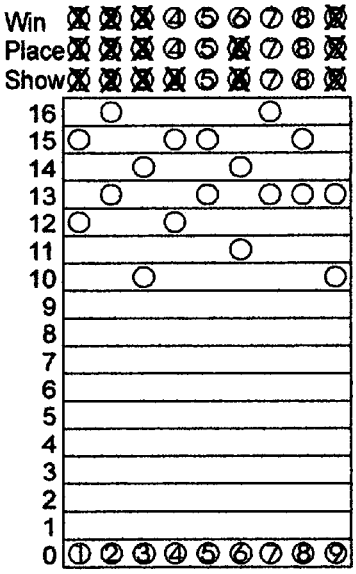

FIG. 2B

Win / Place / Show
Payoff
Bet before 3rd advancement
Total bets: 15
Total amount: $30.00
Race starts at Draw #17
2nd advancement at Draw #27
3rd advancement at Draw #37

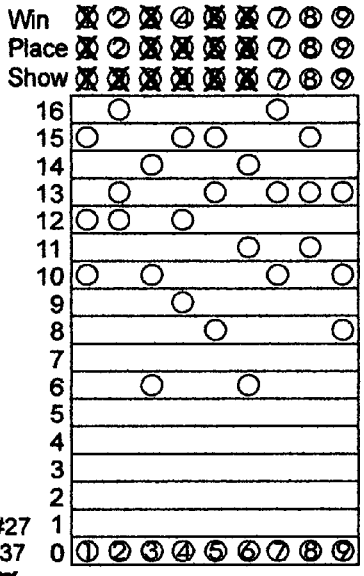

FIG. 2C

Win / Place / Show
Payoff
Bet before the start
Total bets: 15
Total amount: $30.00
Race starts at Draw #17
2nd advancement at Draw #27
3rd advancement at Draw #37

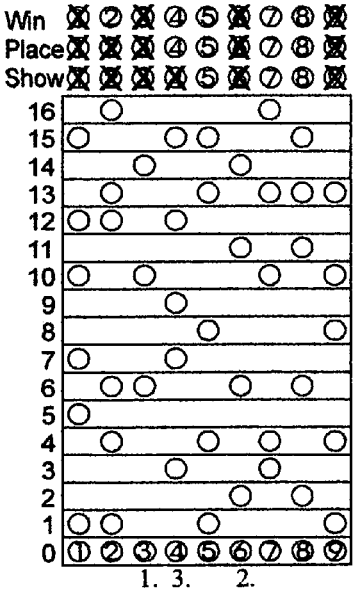

Payoff: $38.22

FIG. 2D

Win / Exacta / Tricta
Payoff
Bet before 2nd advancement
Total bets: 64
Total amount: $32.00
Race starts at Draw #17
2nd advancement at Draw #27
3rd advancement at Draw #37

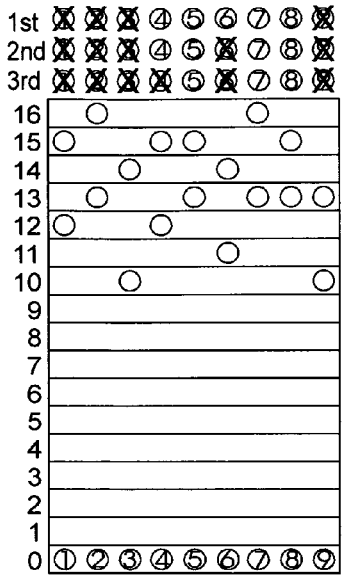

FIG. 3B

Win / Exacta / Tricta
Credit
Bet before 3rd advancement
Total bets: 64
Total amount: $32.00
Race starts at Draw #17
2nd advancement at Draw #27
3rd advancement at Draw #37

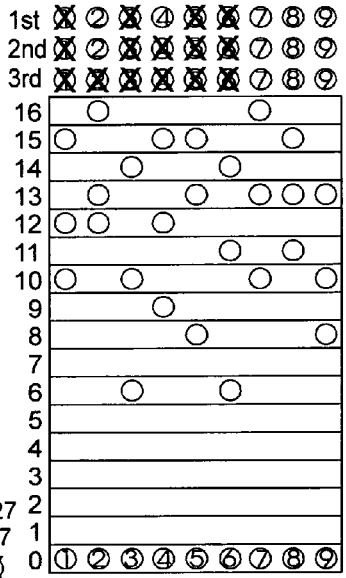

FIG. 3C

Win / Exacta / Tricta
Credit
Bet before the start
Total bets: 64
Total amount: $32.00
Race starts at Draw #17
2nd advancement at Draw #27
3rd advancement at Draw #37

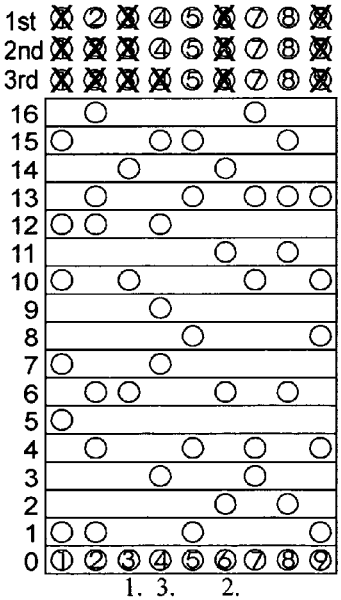

Credit: $211.32

FIG. 3D

Win / Place / Show Total bets: 15*9*9=1,215 Total amount: $121.50
Race 1
Race starts at Draw #17
2nd advancement at Draw #21
3rd advancement at Draw #25
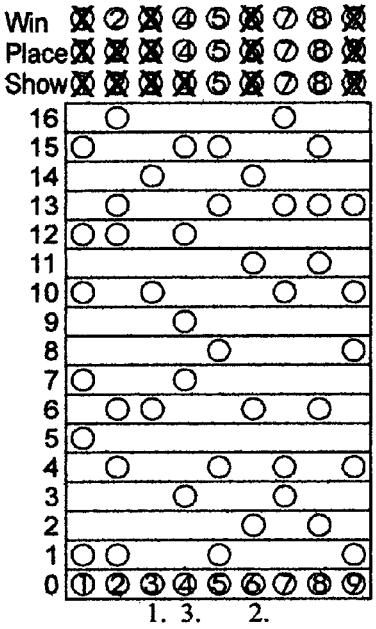
Race 2
Race starts at Draw #37
2nd advancement at Draw #41
3rd advancement at Draw #45
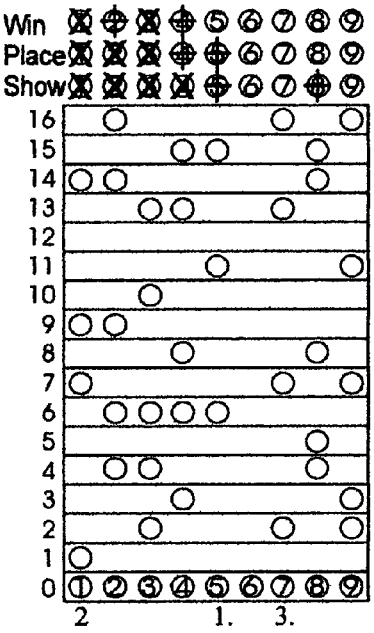
Race 3
Race starts at Draw #57
2nd advancement at Draw #61
3rd advancement at Draw #65
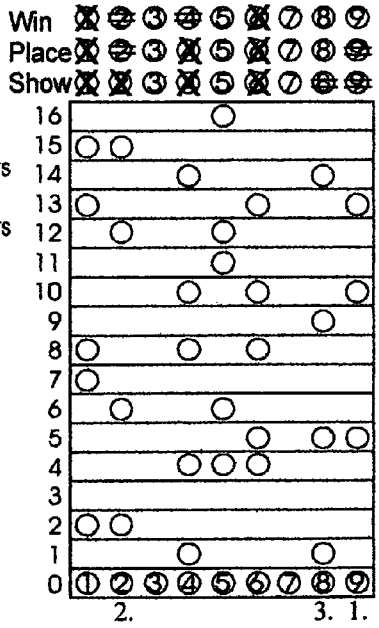
Race 1 credit: $160.21
40% on 6 Race 2 make-up bets
Race 2 credit: $131.60
40% on 6 Race 3 make-up bets
Payoff: $124.67
FIG. 4B Win / Exacta / Tricta Total bets: 64*16*9=9,216 Total amount: $92.16
Race 1
Race starts at Draw #17
2nd advancement at Draw #21
3rd advancement at Draw #25
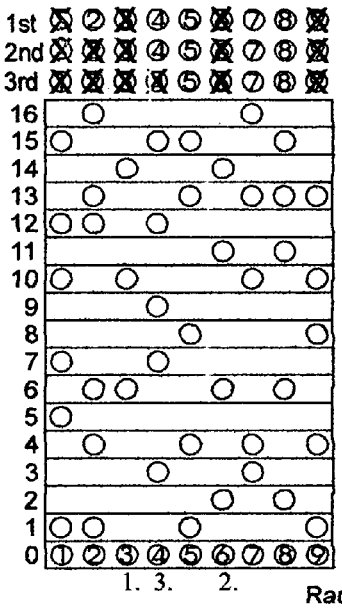
Race 2
Race starts at Draw #37
2nd advancement at Draw #41
3rd advancement at Draw #45
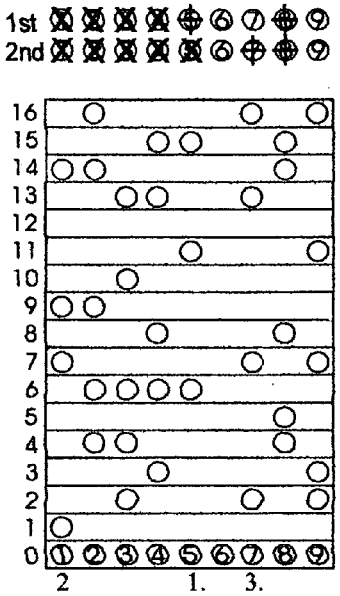
Race 3
Race starts at Draw #57
2nd advancement at Draw #61
3rd advancement at Draw #65
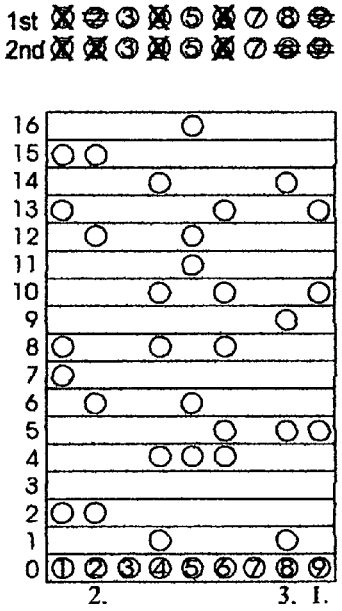
Race 1 credit: $608.61
60% on 20 Race 2 make-up bets
Race 2 credit: $784.29
80% on 16 Race 3 make-up bets
Payoff: $1,109.70
FIG. 5B Account xxx Balance cashable $xxx.xx non-cashable $xxx.xx

| Ticket | Type | Status | Credit/Payoff |
|---|---|---|---|
| #1 | 2-Race Win/Place/Show | out | $xx.xx |
| #2 | 3-Race Win/Exacta/Tricta | out | nil |
| #3 | 1-Race payoff Win/Place/Show | out | $xx.xx |
| #4 | 3-Race Win/Exacta/Tricta | hanging | $xxx.xx |
| #5 | 1-Race credit Win/Place/Show | out | nil |

Bet slip Exit

FIG. 6

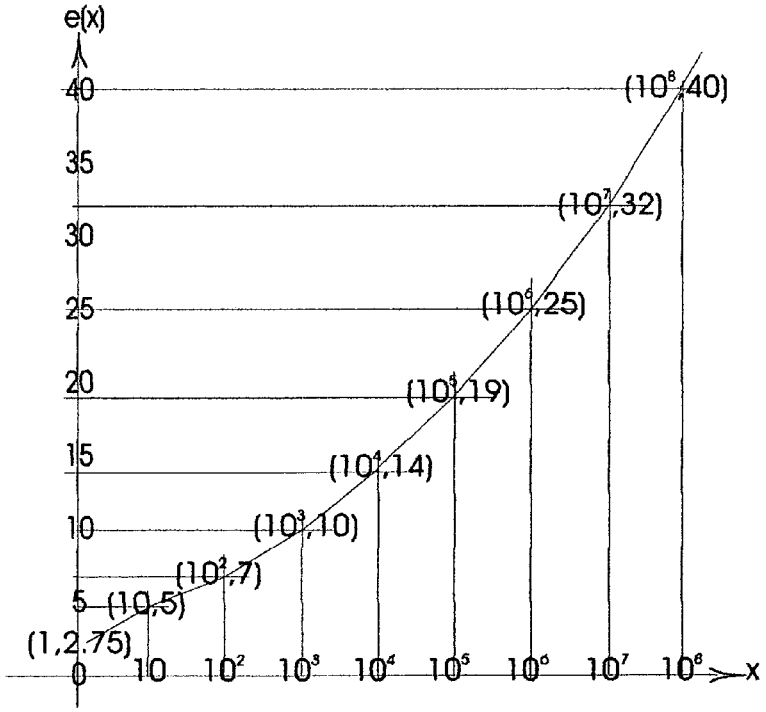

$e(x)=2.5\ x/4$ for $1=<x<=10$ $e(x)=4+(n+1)[n/2+(x-10^n)/9(10^n)]$ for $10<x$ with integer n satisfying $10^n<x<=10^{n+1}$

FIG. 7

Probabilities and $1 bet winner credits
Track: 15 16 14 15 15 14 16 15 13

WIN

| #1 | #2 | #3 | #4 | #5 | #6 | #7 | #8 | #9 |
|---|---|---|---|---|---|---|---|---|
| .21836993 | .10227217 | .20501718 | .09531207 | .07817446 | .10959784 | .02754862 | .04807642 | .11563127 |
| $4.58 | $9.78 | $4.88 | $10.49 | $12.79 | $9.12 | $36.30 | $20.80 | $8.65 |

PLACE

| #1 | #2 | #3 | #4 | #5 | #6 | #7 | #8 | #9 |
|---|---|---|---|---|---|---|---|---|
| .37311250 | .22581133 | .37198853 | .21424642 | .17580718 | .22269434 | .07051260 | .10740980 | .23841733 |
| $2.68 | $4.43 | $2.69 | $4.67 | $5.69 | $4.49 | $14.18 | $9.31 | $4.19 |

SHOW

| #1 | #2 | #3 | #4 | #5 | #6 | #7 | #8 | #9 |
|---|---|---|---|---|---|---|---|---|
| .47724363 | .39268690 | .53737468 | .35450968 | .28814036 | .32851860 | .12903824 | .16880864 | .32367918 |
| $2.10 | $2.55 | $1.86 | $2.82 | $3.47 | $3.04 | $7.75 | $5.92 | $3.09 |

FIG. 8A

Probabilities and $1 bet winner credits
Track: 12 13 10 12 13 11 13 13

WIN

| #1 | #2 | #3 | #4 | #5 | #6 | #7 | #8 | #9 |
|---|---|---|---|---|---|---|---|---|
| .24777581 | .10201421 | .32068744 | .06878312 | .02156709 | .09359216 | .00869376 | .00643660 | .13044980 |
| $4.04 | $9.80 | $3.12 | $14.54 | $46.37 | $10.68 | $115.03 | $155.36 | $7.67 |

PLACE

| #1 | #2 | #3 | #4 | #5 | #6 | #7 | #8 | #9 |
|---|---|---|---|---|---|---|---|---|
| .39176500 | .23014885 | .53544164 | .21198577 | .09857617 | .21655814 | .05038223 | .03948947 | .22565275 |
| $2.55 | $4.35 | $1.87 | $4.72 | $10.14 | $4.62 | $19.85 | $25.32 | $4.43 |

SHOW

| #1 | #2 | #3 | #4 | #5 | #6 | #7 | #8 | #9 |
|---|---|---|---|---|---|---|---|---|
| .48611856 | .39579657 | .68093830 | .36284953 | .19795634 | .33970699 | .11799218 | .09570195 | .32293954 |
| $2.06 | $2.53 | $1.47 | $2.76 | $5.05 | $2.94 | $8.48 | $10.45 | $3.10 |

FIG. 8B

Probabilities and $1 bet winner credits
Track: 10 12 6 9 8 6 10 11 8

WIN

| #1 | #2 | #3 | #4 | #5 | #6 | #7 | #8 | #9 |
|---|---|---|---|---|---|---|---|---|
| .12219591 | .01796132 | .54458159 | .05245795 | .05658321 | .19160999 | .00439468 | .00183088 | .00838440 |
| $8.18 | $55.68 | $1.84 | $19.06 | $17.67 | $5.22 | $227.55 | $546.18 | $119.27 |

PLACE

| #1 | #2 | #3 | #4 | #5 | #6 | #7 | #8 | #9 |
|---|---|---|---|---|---|---|---|---|
| .21584985 | .04453307 | .72505695 | .22009417 | .25351435 | .42776373 | .03331757 | .01423880 | .06563141 |
| $4.63 | $22.46 | $1.38 | $4.54 | $3.94 | $2.34 | $30.01 | $70.23 | $15.24 |

SHOW

| #1 | #2 | #3 | #4 | #5 | #6 | #7 | #8 | #9 |
|---|---|---|---|---|---|---|---|---|
| .33576941 | .13131382 | .80675584 | .36295882 | .40251815 | .63374454 | .10006808 | .04370293 | .18316840 |
| $2.98 | $7.62 | $1.24 | $2.76 | $2.48 | $1.58 | $9.99 | $22.88 | $5.46 |

FIG. 8C

TRICTA probabilities and $1 bet winner credits
Track: 15 16 14 15 15 14 16 15 13

| j | 3-j-1 | 3-j-2 | 3-j-3 | 3-j-4 | 3-j-5 | 3-j-6 | 3-j-7 | 3-j-8 | 3-j-9 |
|---|---|---|---|---|---|---|---|---|---|
| 1 | ---------- | .01443911 | ---------- | .00712641 | .00277593 | .00118710 | .00033174 | .00016821 | .00007830 |
| 2 | .00002445 | ---------- | ---------- | .00749852 | .00291629 | .00124561 | .00034788 | .00017628 | .00008202 |
| 3 | ---------- | ---------- | ---------- | ---------- | ---------- | ---------- | ---------- | ---------- | ---------- |
| 4 | .00388675 | .00169086 | ---------- | ---------- | .01647806 | .01310728 | .00426412 | .00422530 | .00510576 |
| 5 | .00388675 | .00169086 | ---------- | .00130820 | ---------- | .01310728 | .00426412 | .00422530 | .00510576 |
| 6 | .00674602 | .00298297 | ---------- | .00236604 | .00136789 | ---------- | .00644003 | .00656224 | .00843030 |
| 7 | .00212970 | .00090462 | ---------- | .00067355 | .00037505 | .00025786 | ---------- | .00266517 | .00299327 |
| 8 | .00388675 | .00169086 | ---------- | .00130820 | .00074556 | .00052342 | .00017599 | ---------- | .00510576 |
| 9 | .01142924 | .00512020 | ---------- | .00413997 | .00241915 | .00173532 | .00058673 | .00051106 | ---------- |

| j | 3-j-1 | 3-j-2 | 3-j-3 | 3-j-4 | 3-j-5 | 3-j-6 | 3-j-7 | 3-j-8 | 3-j-9 |
|---|---|---|---|---|---|---|---|---|---|
| 1 | ---------- | $69.26 | ---------- | $140.32 | $360.24 | $842.39 | $3014.39 | $5944.84 | $12770.82 |
| 2 | $40902.05 | ---------- | ---------- | $133.36 | $342.90 | $802.82 | $2874.57 | $5672.76 | $12191.73 |
| 3 | ---------- | ---------- | ---------- | ---------- | ---------- | ---------- | ---------- | ---------- | ---------- |
| 4 | $257.28 | $591.42 | ---------- | ---------- | $60.69 | $76.29 | $234.52 | $236.67 | $195.86 |
| 5 | $257.28 | $591.42 | ---------- | $764.41 | ---------- | $76.29 | $234.52 | $236.67 | $195.86 |
| 6 | $148.24 | $335.24 | ---------- | $422.65 | $731.06 | ---------- | $155.28 | $152.39 | $118.62 |
| 7 | $469.55 | $1105.44 | ---------- | $1484.66 | $2666.28 | $3878.10 | ---------- | $375.21 | $334.08 |
| 8 | $257.28 | $591.42 | ---------- | $764.41 | $1341.27 | $1910.50 | $5682.23 | ---------- | $195.86 |
| 9 | $87.49 | $195.31 | ---------- | $241.55 | $413.37 | $576.26 | $1704.37 | $1956.73 | ---------- |

FIG. 9A

TRICTA probabilities and $1 bet winner credits
Track: 12 13 10 12 13 11 13 13 10

| j | 3-j-1 | 3-j-2 | 3-j-3 | 3-j-4 | 3-j-5 | 3-j-6 | 3-j-7 | 3-j-8 | 3-j-9 |
|---|---|---|---|---|---|---|---|---|---|
| 1 | ---------- | .02957446 | ---------- | .01390883 | .00451122 | .00244647 | .00061304 | .00027361 | .00016589 |
| 2 | .00004490 | ---------- | ---------- | .01456891 | .00470239 | .00253808 | .00063472 | .00028277 | .00017118 |
| 3 | ---------- | ---------- | ---------- | ---------- | ---------- | ---------- | ---------- | ---------- | ---------- |
| 4 | .00607523 | .00221439 | ---------- | ---------- | .02223077 | .02784563 | .00848571 | .00620665 | .01032172 |
| 5 | .00299086 | .00101265 | ---------- | .00051732 | ---------- | .01699134 | .00524615 | .00383387 | .00594597 |
| 6 | .01140566 | .00436244 | ---------- | .00315777 | .00130785 | ---------- | .01312470 | .00960047 | .01709113 |
| 7 | .00299086 | .00101265 | ---------- | .00051732 | .00017530 | .00009902 | ---------- | .00383388 | .00594597 |
| 8 | .00299086 | .00101265 | ---------- | .00051732 | .00017530 | .00009902 | .00002523 | ---------- | .00594597 |
| 9 | .02005098 | .00789005 | ---------- | .00607475 | .00258164 | .00286003 | .00086844 | .00061548 | ---------- |

| j | 3-j-1 | 3-j-2 | 3-j-3 | 3-j-4 | 3-j-5 | 3-j-6 | 3-j-7 | 3-j-8 | 3-j-9 |
|---|---|---|---|---|---|---|---|---|---|
| 1 | ---------- | $33.81 | ---------- | $71.90 | $221.67 | $408.75 | $1631.21 | $3654.83 | $6028.19 |
| 2 | $22272.81 | ---------- | ---------- | $68.64 | $212.66 | $394.00 | $1575.50 | $3536.48 | $5841.75 |
| 3 | ---------- | ---------- | ---------- | ---------- | ---------- | ---------- | ---------- | ---------- | ---------- |
| 4 | $164.60 | $451.59 | ---------- | ---------- | $44.98 | $35.91 | $117.85 | $161.12 | $96.88 |
| 5 | $334.35 | $987.51 | ---------- | $1933.06 | ---------- | $58.85 | $190.62 | $260.83 | $168.18 |
| 6 | $87.68 | $229.23 | ---------- | $316.68 | $764.61 | ---------- | $76.19 | $104.16 | $58.51 |
| 7 | $334.35 | $987.51 | ---------- | $1933.05 | $5704.52 | $10098.83 | ---------- | $260.83 | $168.18 |
| 8 | $334.35 | $987.51 | ---------- | $1933.05 | $5704.55 | $10098.84 | $39630.80 | ---------- | $168.18 |
| 9 | $49.87 | $126.74 | ---------- | $164.62 | $387.35 | $349.65 | $1151.49 | $1624.75 | ---------- |

FIG. 9B

TRICTA probabilities and $1 bet winner credits
Track: 10 12 6 9 8 6 10 11 8

| j | 3-j-1 | 3-j-2 | 3-j-3 | 3-j-4 | 3-j-5 | 3-j-6 | 3-j-7 | 3-j-8 | 3-j-9 |
|---|---|---|---|---|---|---|---|---|---|
| 1 | ---------- | .01864459 | ---------- | .01463106 | .00497452 | .00144121 | .00014980 | .00005388 | .00004512 |
| 2 | .00000286 | ---------- | ---------- | .00594577 | .00168532 | .00042330 | .00003990 | .00001344 | .00001045 |
| 3 | ---------- | ---------- | ---------- | ---------- | ---------- | ---------- | ---------- | ---------- | ---------- |
| 4 | .00648012 | .00189160 | ---------- | ---------- | .06428856 | .05519025 | .00466626 | .00193188 | .00847193 |
| 5 | .01203181 | .00351240 | ---------- | .00404640 | ---------- | .10222904 | .00863651 | .00357684 | .01572410 |
| 6 | .04066180 | .01116092 | ---------- | .01836686 | .01166958 | ---------- | .02597414 | .01075227 | .04711344 |
| 7 | .00337170 | .00098408 | ---------- | .00113329 | .00045805 | .00014676 | ---------- | .00101283 | .00441255 |
| 8 | .00153505 | .00044784 | ---------- | .00051539 | .00020826 | .00006672 | .00000734 | ---------- | .00201433 |
| 9 | .01203181 | .00351240 | ---------- | .00404640 | .00163567 | .00052411 | .00005764 | .00002144 | ---------- |

| j | 3-j-1 | 3-j-2 | 3-j-3 | 3-j-4 | 3-j-5 | 3-j-6 | 3-j-7 | 3-j-8 | 3-j-9 |
|---|---|---|---|---|---|---|---|---|---|
| 1 | ---------- | $53.63 | ---------- | $68.35 | $201.02 | $693.86 | $6675.48 | $18560.88 | $22163.91 |
| 2 | $349522.16 | ---------- | ---------- | $168.19 | $593.36 | $2362.40 | $25062.29 | $74409.89 | $95724.23 |
| 3 | ---------- | ---------- | ---------- | ---------- | ---------- | ---------- | ---------- | ---------- | ---------- |
| 4 | $154.32 | $528.65 | ---------- | ---------- | $15.55 | $18.12 | $214.30 | $517.63 | $118.04 |
| 5 | $83.11 | $284.71 | ---------- | $247.13 | ---------- | $9.78 | $115.79 | $279.58 | $63.60 |
| 6 | $24.59 | $89.60 | ---------- | $54.45 | $85.69 | ---------- | $38.50 | $93.00 | $21.23 |
| 7 | $296.59 | $1016.18 | ---------- | $882.39 | $2183.16 | $6813.73 | ---------- | $987.33 | $226.63 |
| 8 | $651.45 | $2232.95 | ---------- | $1940.27 | $4801.63 | $14987.82 | $136281.81 | ---------- | $496.44 |
| 9 | $83.11 | $284.71 | ---------- | $247.13 | $611.37 | $1907.99 | $17347.67 | $46648.89 | ---------- |

FIG. 9C

TRICTA probabilities
Track: 12 13 10 12 13 11 13 13 10

| j | 2-j-1 | 2-j-2 | 2-j-3 | 2-j-4 | 2-j-5 | 2-j-6 | 2-j-7 | 2-j-8 | 2-j-9 |
|---|---|---|---|---|---|---|---|---|---|
| 1 | ---------- | ---------- | .00149028 | .00022475 | .00005182 | .00001701 | .00000308 | .00000090 | .00000031 |
| 2 | ---------- | ---------- | ---------- | ---------- | ---------- | ---------- | ---------- | ---------- | ---------- |
| 3 | .00219119 | ---------- | ---------- | .02183434 | .00991657 | .01234751 | .00381843 | .00279848 | .00435239 |
| 4 | .00099607 | ---------- | .00045679 | ---------- | .00451433 | .00561636 | .00173664 | .00127248 | .00197863 |
| 5 | .00062774 | ---------- | .00028784 | .00006214 | ---------- | .00355008 | .00109708 | .00080303 | .00124737 |
| 6 | .00149394 | ---------- | .00068514 | .00014793 | .00005014 | ---------- | .00260272 | .00190772 | .00296733 |
| 7 | .00062774 | ---------- | .00028784 | .00006214 | .00002106 | .00001190 | ---------- | .00080303 | .00124737 |
| 8 | .00062774 | ---------- | .00028784 | .00006214 | .00002106 | .00001190 | .00000303 | ---------- | .00124737 |
| 9 | .00219119 | ---------- | .00100489 | .00021697 | .00007353 | .00004154 | .00001059 | .00000480 | ---------- |

TRICTA probabilities
Track: 10 12 6 9 8 6 10 11 8

| i | 5-j-1 | 5-j-2 | 5-j-3 | 5-j-4 | 5-j-5 | 5-j-6 | 5-j-7 | 5-j-8 | 5-j-9 |
|---|---|---|---|---|---|---|---|---|---|
| 1 | ---------- | .00284787 | .00161806 | .00011643 | ---------- | .00002808 | .00000189 | .00000045 | .00000018 |
| 2 | .00000002 | ---------- | .00123547 | .00008889 | ---------- | .00002144 | .00000144 | .00000034 | .00000013 |
| 3 | .00000040 | .00000006 | ---------- | .00160011 | ---------- | .00038597 | .00002599 | .00000620 | .00000241 |
| 4 | .00000025 | .00000004 | .00000001 | ---------- | ---------- | .00023751 | .00001599 | .00000382 | .00000148 |
| 5 | ---------- | ---------- | ---------- | ---------- | ---------- | ---------- | ---------- | ---------- | ---------- |
| 6 | .00924795 | .00270027 | .00404498 | .00051840 | ---------- | ---------- | .00656411 | .00272190 | .01206989 |
| 7 | .00092565 | .00027021 | .00040460 | .00005185 | ---------- | .00002419 | ---------- | .00027564 | .00120998 |
| 8 | .00042139 | .00012296 | .00018399 | .00002357 | ---------- | .00001100 | .00000121 | ---------- | .00055223 |
| 9 | .00330275 | .00096436 | .00144463 | .00018514 | ---------- | .00008638 | .00000950 | .00000353 | ---------- |

FIG. 9D

Probabilities and $1 bet winner credits
Track: 14 16 13 15 15 0 16 15 16

WIN

| #1 | #2 | #3 | #4 | #5 | #6 | #7 | #8 | #9 |
|---|---|---|---|---|---|---|---|---|
| 35627395 | .10481131 | .28917256 | .08103321 | .06576834 | ---------- | .03026301 | .04986899 | .02280864 |
| $2.81 | $9.54 | $3.46 | $12.34 | $15.20 | ---------- | $33.04 | $20.05 | $43.84 |

PLACE

| #1 | #2 | #3 | #4 | #5 | #6 | #7 | #8 | #9 |
|---|---|---|---|---|---|---|---|---|
| .53723145 | .25732288 | .52420032 | .22265267 | .17765407 | ---------- | .09102572 | .12672615 | .06318675 |
| $1.86 | $3.89 | $1.91 | $4.49 | $5.63 | ---------- | $10.99 | $7.89 | $15.83 |

SHOW

| #1 | #2 | #3 | #4 | #5 | #6 | #7 | #8 | #9 |
|---|---|---|---|---|---|---|---|---|
| .64586252 | .46356648 | .70189232 | .38693720 | .30504006 | ---------- | .17220974 | .20982595 | .11466564 |
| $1.55 | $2.16 | $1.42 | $2.58 | $3.28 | ---------- | $5.81 | $4.77 | $8.72 |

FIG. 10

EXACTA probabilities and $1 bet winner credits
Track: 14 16 13 15 15 0 16 15 16

| i | i-1 | i-2 | i-3 | i-4 | i-5 | i-6 | i-7 | i-8 | i-9 |
|---|---|---|---|---|---|---|---|---|---|
| 1 | ---------- | .09632292 | .14649166 | .04437801 | .03007749 | ---------- | .01414302 | .01694828 | .00791253 |
| 2 | .01169401 | ---------- | .05296338 | .01627697 | .01066047 | ---------- | .00503662 | .00556512 | .00261474 |
| 3 | .07606707 | .02538151 | ---------- | .07258794 | .04973708 | ---------- | .02334684 | .02868578 | .01336632 |
| 4 | .02326948 | .00770748 | .00894897 | ---------- | .01808519 | ---------- | .00852153 | .00987729 | .00462326 |
| 5 | .02326949 | .00770748 | .00894897 | .00282036 | ---------- | ---------- | .00852152 | .00987729 | .00462326 |
| 6 | ---------- | ---------- | ---------- | ---------- | ---------- | ---------- | ---------- | ---------- | ---------- |
| 7 | .01169401 | .00384236 | .00436286 | .00136792 | .00081603 | ---------- | ---------- | .00556511 | .00261473 |
| 8 | .02326949 | .00770748 | .00894897 | .00282035 | .00169343 | ---------- | .00080600 | ---------- | .00462327 |
| 9 | .01169401 | .00384236 | .00436286 | .00136792 | .00081603 | ---------- | .00038716 | .00033829 | ---------- |

| i | i-1 | i-2 | i-3 | i-4 | i-5 | i-6 | i-7 | i-8 | i-9 |
|---|---|---|---|---|---|---|---|---|---|
| 1 | ---------- | $10.38 | $6.83 | $22.53 | $33.25 | ---------- | $70.71 | $59.00 | $126.38 |
| 2 | $85.51 | ---------- | $18.88 | $61.44 | $93.80 | ---------- | $198.55 | $179.69 | $382.45 |
| 3 | $13.15 | $39.40 | ---------- | $13.78 | $20.11 | ---------- | $42.83 | $34.86 | $74.81 |
| 4 | $42.97 | $129.74 | $111.74 | ---------- | $55.29 | ---------- | $117.35 | $101.24 | $216.30 |
| 5 | $42.97 | $129.74 | $111.74 | $354.57 | ---------- | ---------- | $117.35 | $101.24 | $216.30 |
| 6 | ---------- | ---------- | ---------- | ---------- | ---------- | ---------- | ---------- | ---------- | ---------- |
| 7 | $85.51 | $260.26 | $229.21 | $731.04 | $1225.44 | ---------- | ---------- | $179.69 | $382.45 |
| 8 | $42.97 | $129.74 | $111.74 | $354.57 | $590.52 | ---------- | $1240.69 | ---------- | $216.30 |
| 9 | $85.51 | $260.26 | $229.21 | $731.04 | $1225.44 | ---------- | $2582.89 | $2956.05 | ---------- |

FIG. 10A

Probabilities and $1 bet winner credits
Track: 15 15 0 14 16 13 0 14 13

WIN

| #1 | #2 | #3 | #4 | #5 | #6 | #7 | #8 | #9 |
|---|---|---|---|---|---|---|---|---|
| .21239865 | .15688063 | ---------- | .18740603 | .05034553 | .19361840 | ---------- | .08794606 | .11140460 |
| $4.71 | $6.37 | ---------- | $5.34 | $19.86 | $5.16 | ---------- | $11.37 | $8.98 |

PLACE

| #1 | #2 | #3 | #4 | #5 | #6 | #7 | #8 | #9 |
|---|---|---|---|---|---|---|---|---|
| .37864834 | .31565630 | ---------- | .35645530 | .13379653 | .36056852 | ---------- | .20221168 | .25266302 |
| $2.64 | $3.17 | ---------- | $2.81 | $7.47 | $2.77 | ---------- | $4.95 | $3.96 |

SHOW

| #1 | #2 | #3 | #4 | #5 | #6 | #7 | #8 | #9 |
|---|---|---|---|---|---|---|---|---|
| .50826150 | .51454920 | ---------- | .53938097 | .26046392 | .49512082 | ---------- | .31538767 | .36683542 |
| $1.97 | $1.94 | ---------- | $1.85 | $3.84 | $2.02 | ---------- | $3.17 | $2.73 |

FIG. 11

EXACTA probabilities and $1 bet winner credits
Track: 15 15 0 14 16 13 0 14 13

| i | i-1 | i-2 | i-3 | i-4 | i-5 | i-6 | i-7 | i-8 | i-9 |
|---|---|---|---|---|---|---|---|---|---|
| 1 | ---------- | .06966019 | ---------- | .05796264 | .01829996 | .03598498 | ---------- | .01526822 | .01522265 |
| 2 | .01414222 | ---------- | ---------- | .05796262 | .01829995 | .03598497 | ---------- | .01526822 | .01522265 |
| 3 | ---------- | ---------- | ---------- | ---------- | ---------- | ---------- | ---------- | ---------- | ---------- |
| 4 | .02609085 | .01525153 | ---------- | ---------- | .02983183 | .06220134 | ---------- | .02660828 | .02742219 |
| 5 | .00707469 | .00403740 | ---------- | .00283805 | ---------- | .02005415 | ---------- | .00840204 | .00793920 |
| 6 | .04642555 | .02728753 | ---------- | .01967090 | .00665930 | ---------- | ---------- | .04554558 | .04802952 |
| 7 | ---------- | ---------- | ---------- | ---------- | ---------- | ---------- | ---------- | ---------- | ---------- |
| 8 | .02609084 | .01525152 | ---------- | .01094417 | .00370065 | .00453667 | ---------- | ---------- | .02742219 |
| 9 | .04642556 | .02728753 | ---------- | .01967090 | .00665930 | .00818800 | ---------- | .00317331 | ---------- |

| i | i-1 | i-2 | i-3 | i-4 | i-5 | i-6 | i-7 | i-8 | i-9 |
|---|---|---|---|---|---|---|---|---|---|
| 1 | ---------- | $14.36 | ---------- | $17.25 | $54.64 | $27.79 | ---------- | $65.50 | $65.69 |
| 2 | $70.71 | ---------- | ---------- | $17.25 | $54.64 | $27.79 | ---------- | $65.50 | $65.69 |
| 3 | ---------- | ---------- | ---------- | ---------- | ---------- | ---------- | ---------- | ---------- | ---------- |
| 4 | $38.33 | $65.57 | ---------- | ---------- | $33.52 | $16.08 | ---------- | $37.58 | $36.47 |
| 5 | $141.35 | $247.68 | ---------- | $352.35 | ---------- | $49.86 | ---------- | $119.02 | $125.96 |
| 6 | $21.54 | $36.65 | ---------- | $50.84 | $150.17 | ---------- | ---------- | $21.96 | $20.82 |
| 7 | ---------- | ---------- | ---------- | ---------- | ---------- | ---------- | ---------- | ---------- | ---------- |
| 8 | $38.33 | $65.57 | ---------- | $91.37 | $270.22 | $220.43 | ---------- | ---------- | $36.47 |
| 9 | $21.54 | $36.65 | ---------- | $50.84 | $150.17 | $122.13 | ---------- | $315.13 | ---------- |

FIG. 11A

RACE GAME ALLOWING SELECTABLE TRACK LENGTHS, RUN SCHEDULES AND PAYOFFS

CROSS REFERENCE TO RELATED APPLICATIONS

This application is related to application Ser. No. 13/999,205, filed on Jan. 8, 2014 (to be abandoned as this one is filed), which is a continuation of abandoned application Ser. No. 12/386,666, filed on Apr. 22, 2009, which again is a continuation of abandoned application Ser. No. 11/299,132 filed on Dec. 12, 2005. All of the above as well as application Ser. No. 13/999,479, filed on Mar. 4, 2014, uses the framework of U.S. Pat. No. 5,795,226, granted on Aug. 18, 1998. The inventor's name was misprinted as Chen Yi. A certificate of correction was issued on Nov. 24, 1998.

BACKGROUND OF THE INVENTION

1. Field of Invention

This invention relates to games of chance, more specifically, to methods of playing a non pari-mutuel race game determined by multiple rounds of random numbers.

2. Prior Art

As far as playing surface is concerned every game with a plurality of racers is prior art. As far as betting is concerned, any game of chance, such as keno, lottery, roulette, bingo is prior art. As far as technology is concerned any game requiring bet slips and computer data processing such as those at racetrack is prior art. As far as U.S. patent classification is concerned, all patents and patent applications in CCL 463/6, 463/16, 463/22, 463/25, 273/246, 273/274 etc. as some listed in the Information Disclosure Statement are in a sense prior art. But no known race game has allowed bettors to scratch a racer or to assign own preferred track length for each racer. There is no gaming operation using random numbers to determine racer advancements of various racecourses. There is no non pari-mutuel wagering system allowing players to earn no house edge credit. Since the beginning of PC era, race games have been more or less computerized. Betting games are pari-mutuel or require particular RNG software. For example, U.S. Pat. No. 5,156,397 discloses an apparatus for marking of bet slips for use in entering a customer wager into an independent lottery terminal includes a housing for receiving a bet slip.

U.S. Pat. No. 5,186,460 discloses a computer controlled racing game providing a display of contestants who move from a start to a finish position in response to chance factors determined by the computer and strategically inputs supplied to the computer by the players.

U.S. Pat. No. 6,152,822 discloses a method of wagering, including the steps of providing a random number generator that has a wagering base, which is randomly accessed by an input wager.

U.S. Patent Application 20050176495 discloses a wagering system on race events has pools wherein an initial wager is placed by a player in an wagering terminal that automatically selects race contestants for wagers on a racing event.

U.S. Patent Application 20110287822 discloses a method comprising the steps of generating a first outcome, and then a second outcome based on the first outcome.

U.S. Pat. No. 8,142,269 discloses a gaming machine for racing game and playing method, which displays a horse racing game in which racehorses race against each other, and receives, via a gaming terminal, a bet made by a player regarding finish order.

3. Objects and Advantages

The initial object is to improve the game disclosed in U.S. Pat. No. 5,795,226. Its non-automatic version requires a 8' by 8' table to set up a race course with betting sections, an exquisite rolling dice box to generate random numbers, and so on, all made-to-order only. Its operation requires several workers. All this means high cost, which will result in high house edge. Besides, there is always only one fixed race running for all players to bet on. Further objects are as follow:

(1) To get rid of any physical playing table by printing the racecourse on a bet slip.

(2) To use keno balls instead of dice so that random numbers can be other than 1 to 6.

(3) To allow a player using a bet slip to set up a race card of one or more racecourses with own preferred number of racers and preferred track lengths to play a 1-race or multi-race game.

(4) To allow the operator to schedule draws of random numbers for racer advancements and any player anytime to submit a race card, on which the player selects which forthcoming draws will be applicable to advance racers of own set up races.

(5) To allow a player to earn either house edged payoff or non-cashable credit without house edge for placing bets like cash.

Casinos have taken advantage of computer technology to bring out a variety of slots/video game machines. But basically they are only attractive to really simple-minded people. Sophisticated players never touch them because hidden random outcomes may be manipulated despite under government ruling and testing control. Their common characteristics are:

(A') Every player occupies one individual machine throughout the whole playing period.

(B') Most machines are bulky, mesmerizing with video displays, high-tech sound effects for entertainment purpose only. Each costs thousands of dollars to manufacture and transport.

(C') Physical/simulated wheels/reels.

(D') Hidden virtual wheels/reel to produce outcomes technically known to the operator only.

(E') RNG software and PAR sheet to ensure operator's maximal profit allowed by government gaming regulations.

(F') Regardless of millions of possible outcomes, for the player actually only limited number available to bet on.

(G') Besides limited number of paylines, there are "multi-line", "bonus-round", "option-buy", "scatter-pay", "progressive" etc., just luring less intelligent people to wager more and hard to get up from the machine with a possibility of money left to be won. But there is no information material about which, when and how the possibility may occur.

This invention is to disclose a gaming operation with the following advantages:

(A) There are no physical racers, racecourses, heavy machines or reels/wheels.

(B) By means of a bet slip anyone can start a race anytime.

(B1) Anywhere electronically connected to the game control center can place bets by pointer clicking or screen touching.

(C) On a bet slip the player sets up a racecourse with own preferred number of racers and individual track lengths.

(C1) The player scratches a racer by marking no start spot.

(C2) The player selects a draw interval to determine which upcoming random number draws shall be applicable to the own set-up races so that make-up bets can be placed at leisure.

(C3) The player doesn't need to stay in front of individual machines to watch outcomes.

(D) A single set of random numbers to determine the advancement of all races (D1) Due to no virtual reels/wheels or hidden RNG, all outcomes are predictable.

(D2) There are billions possible exotic bets on any amount of billions possible outcomes with winning probabilities ranging from 100% to a billionth, all calculable by mathematical formulae.

(E) There are multi-draw bets resulting in hanging bets earning non-cashable credit, which may be used to place make-up bets or any other bets like cash.

(E1) Credit betting is to give up a less probable bigger win for a more probable smaller win; and thus also reducing the operator's risk of a huge payoff.

(E2) Players are assured that the game operator's only advantage is house edge so that they can figure out own scientific playing systems, in advance, including using predictable hanging credits.

(F) House edges based on total winning probability, to be applied only at the time of payoff, which is fair and simple for both bettor and gaming operator, and possibly also taxation.

(G) The player can obtain a printout at the end of a game recording all wagering data and racer advancement results regardless of winning any credit, payoff or not.

SUMMARY OF THE INVENTION

The invention provides a race game operation with racecourses printed on a bet slip. Every racer has own track of spots to advance to one fixed finish spot, while its start spot is to be marked by the player. Any racer without a marked start spot will be scratched from the race.

For racer advancements, there is for each racer one random number generator, called drawing device. The preferred drawing device is a keno bowl containing equally many, say, five copies of balls with numeral, say, 1 to 6. Scheduled by the game control center, a round of drawing one ball for each racer occurs, called a draw, starting from Racer 1 bowl. Draws will be numbered as Draw #1, Draw #2, etc., in general, Draw #n, Drawn numerals will be displayed on monitors and input into the control center computer so that racers will advance as many spots as drawn numerals whenever applicable, explained as follows.

On a bet slip, in order to determine which upcoming draws will be applicable to advance racers of own set-up race card, the player selects a draw interval between two advancements or between two races. However, the applicable draw to start the first or the only race will be assigned by the computer and shown on the bet ticket, which should occur about four minutes after bets being placed. Selecting draw interval is to allow the player to place make-up bets at leisure between two advancements or two races.

The invention provides a wagering system allowing 1-race credit or payoff bets and multi-race bet. The credit bet winner earns non-cashable credit without house edge, which can be used like cash to place bets. The payoff bet winner earns house edged payoff.

A multi-race bet becomes or remains hanging if it contains a winner in the last race and thus stays in a position to win at the end. The hanging bet holder earns non-cashable credit and has the option to use a selectable percentage for placing bets related or unrelated to any race of the hanging ticket.

There are wagering machines to examine bet slips and issue bet tickets showing all wagering data together with set-up races and applicable Draws. They are connected to the control center computer to store and process wagering data, to advance racers according to applicable draws, and to determine race results with winner credits and payoffs.

A bet ticket holder can obtain from any wagering machine a printout showing updated racer locations of own set-up race for sake of information or being used to place make-up bets.

Probability formulae as well as how to calculate winner credits, hanging credits and payoffs will be provided.

The invention also includes an automatic video/computer version of the game.

DRAWING FIGURES

FIGS. 2A, 2B and 2C are each a 1-race Win/Place/Show bet ticket.

FIG. 2D is a printout recording final results of the ticket shown in FIG. 2A with finishing order marked below the finish line.

FIGS. 3A, 3B and 3C are each a 1-race Win/Exacta/Tricta bet ticket.

FIG. 3D is a printout recording results of the bet ticket shown in FIG. 3A with finishing order marked below the finish line.

FIG. 4B is a printout recording results of the bet ticket shown in FIG. 4A with finishing orders marked below the finish line.

FIG. 5B is a printout recording results of the bet ticket shown in FIG. 5A with finishing orders marked below the finish line.

FIG. 6 shows an account/activity statement.

FIG. 7 is a line graph to show house edge formulas.

Figure 2:
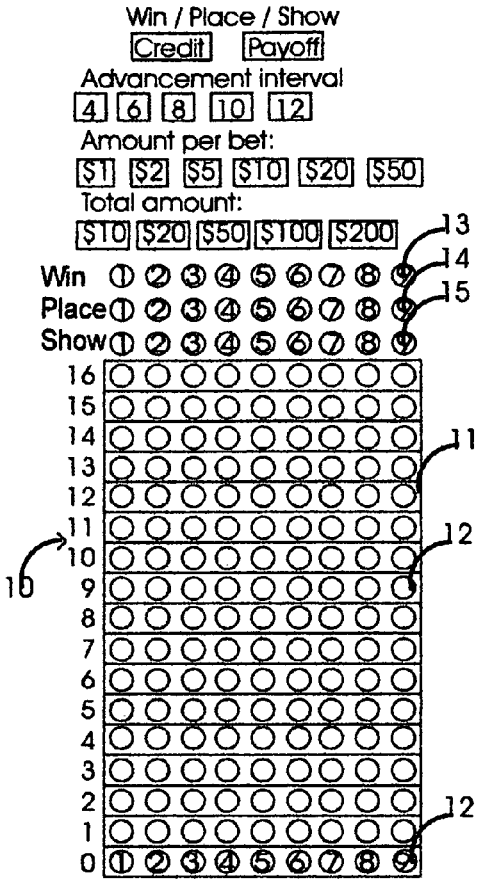
FIG. 2 is a 1-race Win/Place/Show bet slip.
Figure 2A:
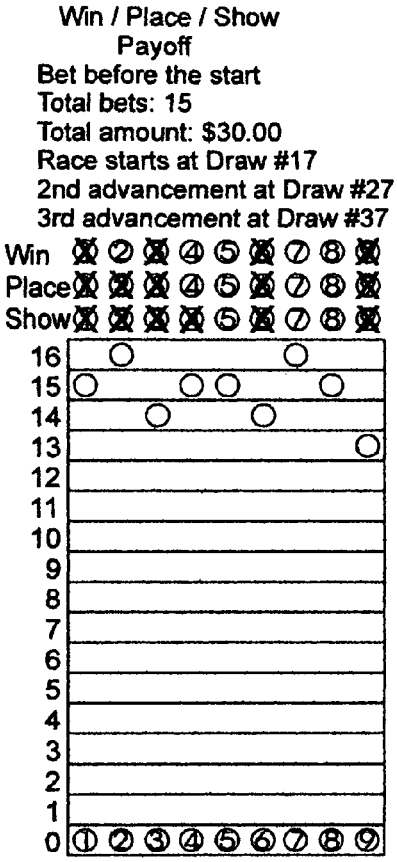

FIGS. 8A, 8B and 8C display Win/Place/Show winning probabilities and $1 bet winner credits related to the bet ticket shown in FIGS. 2A, 2B and 2C respectively.

Figure 3:
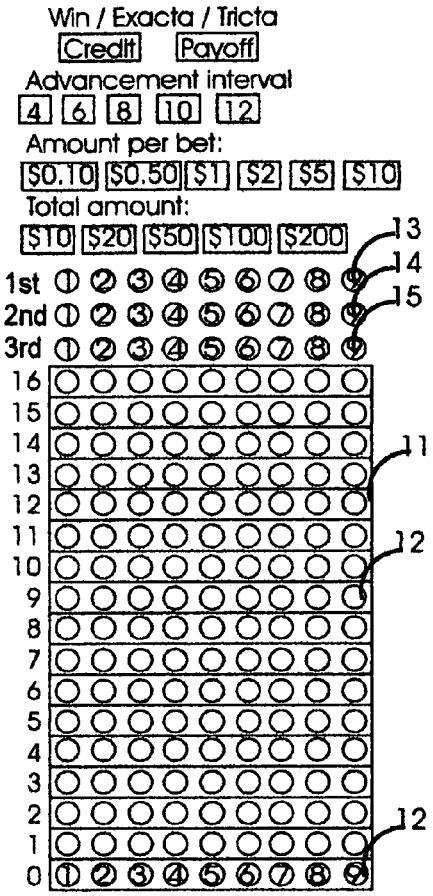
FIG. 3 is a 1-race Win/Exacta/Tricta bet slip.
Figure 3A:
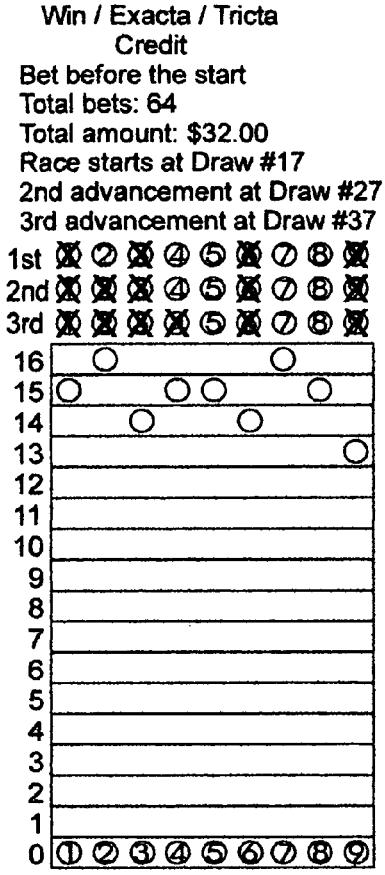

FIGS. 9A, 9B and 9C display Tricta winning probabilities and $1 bet winner credits related to the bet ticket shown in FIGS. 3A, 3B and 3C respectively.

FIG. 9D displays Tricta winning probabilities related to bet tickets shown in FIGS. 3B and 3C.

Figure 4:
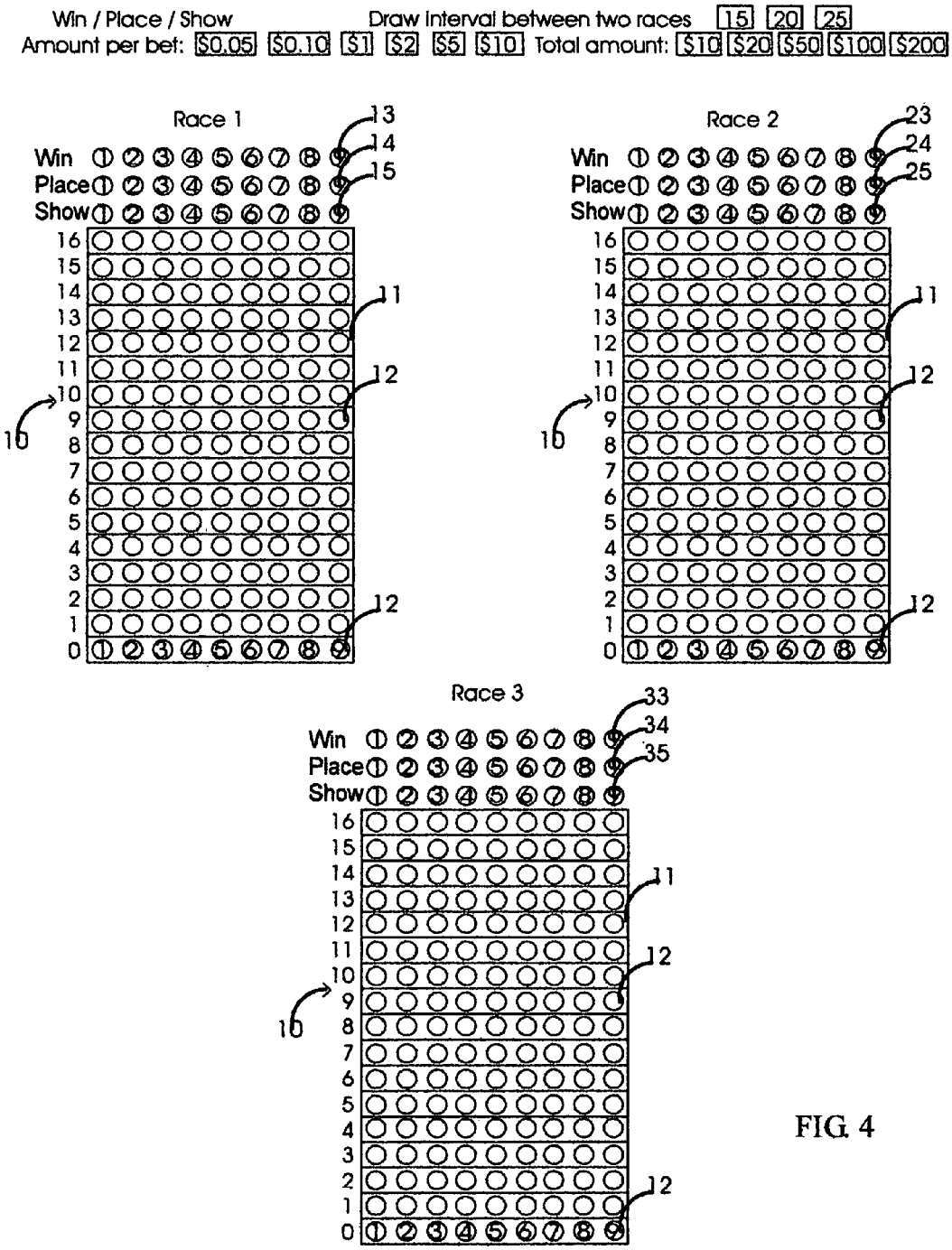
FIG. 4 is a multi-race Win/Place/Show bet slip.
Figure 4A:
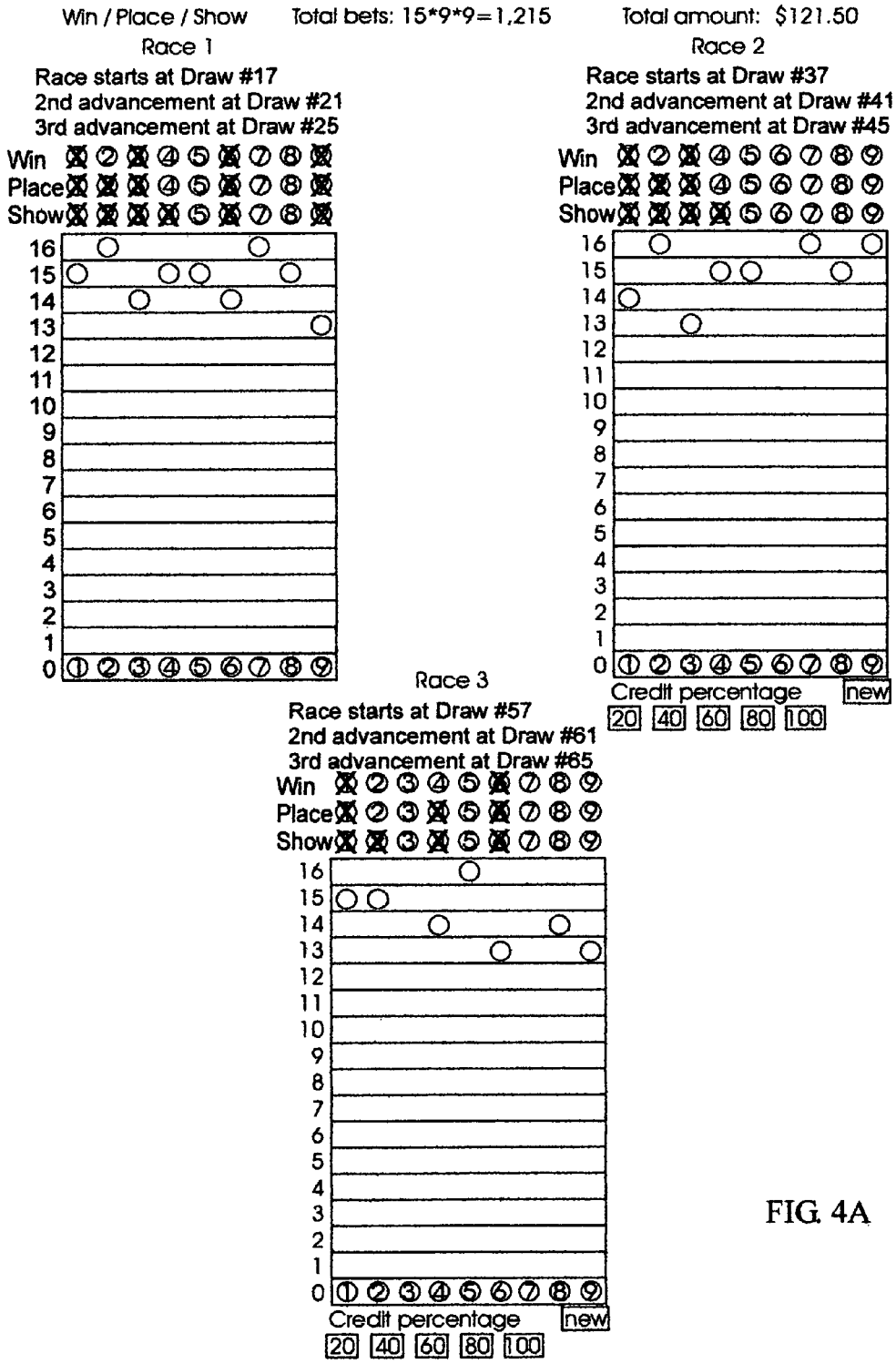
FIG. 4A is a multi-race Win/Place/Show bet ticket.

FIG. 10 displays Win/Place/Show winning probabilities and $1 bet winner credits related to Race 2 of the bet ticket shown in FIGS. 4A and 4B.

Figure 5:
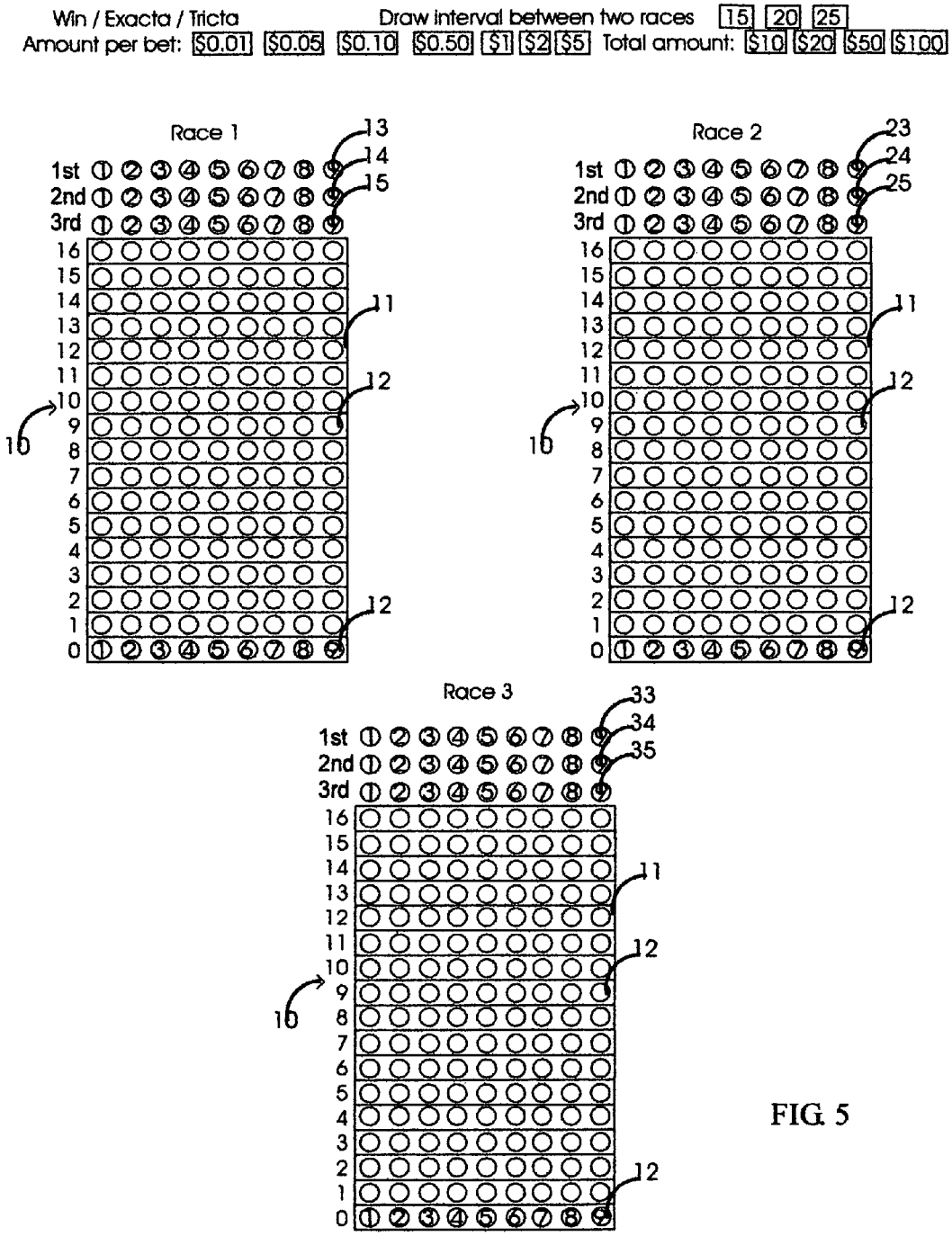
FIG. 5 is a multi-race Win/Exacta/Tricta bet slip.
Figure 5A:
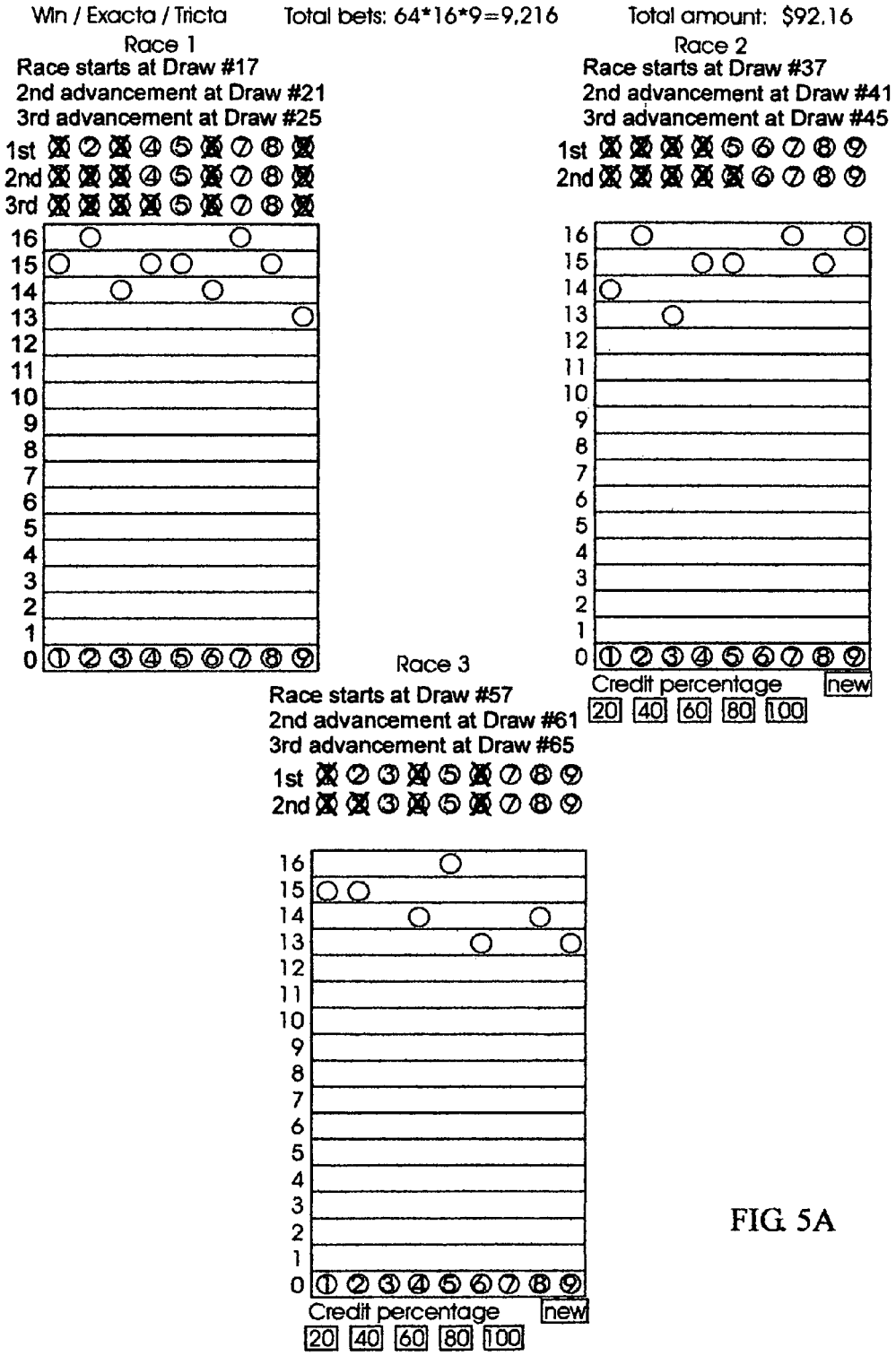
FIG. 5A is a multi-race Win/Exacta/Tricta bet ticket.

FIG. 10A displays Exacta winning probabilities and $1 bet winner credits related to Race 2 of the bet ticket shown in FIGS. 5A and 5B.

FIG. 11 displays Win/Place/Show winning probabilities and $1 bet winner credits related to Race 3 of the bet ticket shown in FIGS. 4A and 4B.

FIG. 11A displays Exacta winning probabilities and $1 bet winner credits related to Race 3 of the bet ticket shown in FIGS. 5A and 5B.

PREFERRED RANDOM NUMBER GENERATORS AND NUMBERED DRAWS

To operate the non-automatic race game using the preferred playing surface specified below requires for each racer one manipulation-proof random number generator, called drawing device. The preferred drawing device is a keno bowl. In each bowl there are equally many, say, four or five balls with numerals, say, 1 to 6.

Figures 1, 1A:
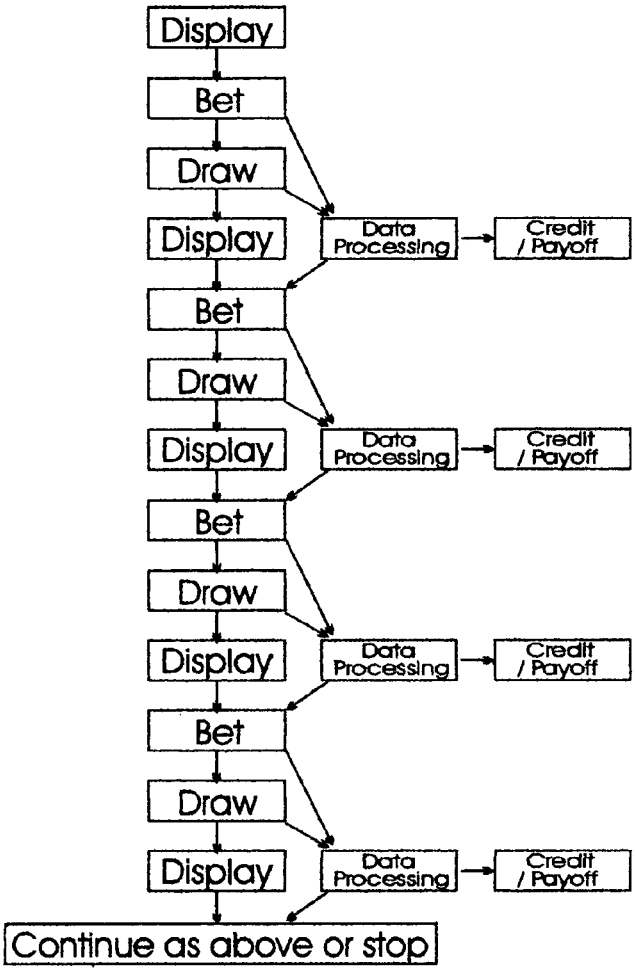
FIG. 1 is a flowchart illustrating the game operation process.
FIG. 1A shows drawn random numerals of numbered draws.

Independent of wagering activity of the game, rounds of drawing take place, called Draw #1, Draw #2, . . . , in general, Draw #n. Each Draw starts from the bowl of racer 1, followed by that of racer 2, and so on till that of racer 9. It will take about 20 second to execute a draw. There will be a pause of one minute between two draws. Drawn numerals will be displayed on monitors as shown in FIG. 1A. Racers advance according to drawn numerals whenever applicable as explained below.

For the automatic version, the preferred drawing device is so-called TIMER-function random number generator using a clock with 8,640,000 centi-seconds per day so that every centi-second elapsed since midnight is assigned to one of numerals 1 to 6. Which centi-second is assigned to which numeral can be made known to the public. There is no fear of manipulation because pressing a button mechanically by a finger nobody is able to catch a desired elapsed centi-second of a day.

PREFERRED PLAYING SURFACES AND THE NON-AUTOMATIC GAME

The preferred playing surface is a racecourse 10 on various bet slips as shown in FIGS. 2, 3, 4 and 5. Each racecourse 10 contains seventeen numbered strips 11. Spots 12 in Strip 0 are where all numbered racers, racer 1, racer 2, and so on are to finish. There is also one spot 12 in each strip lying straight in front of each numbered racer to form a track, where the racer may locate during advancements of a race. The player marks to select one spot 12 for each racer as its start location. Any racer without a marked spot in front will be scratched from the race.

Besides keno bowls and bet slips, to operate the non-automatic game requires wagering machines connected to a game control center computer similarly to at a life racetrack. Any player can insert a marked bet slip into a wagering machine, which displays the inserted slip and provides instructions. The player may also obtain an onscreen bet slip to mark. Following onscreen instructions the player can make corrections and then finalize to issue bet tickets as shown in FIGS. 2A, 3A, 4A and 5A. On each ticket, besides wagering data and racer starting locations, there is Draw #n assigned by the computer to start Race 1 or the only race on the ticket. This assigned Draw #n is supposed to occur approximately four minutes after the ticket being issued. There are other Draw numbers based on the player's draw interval selection as explained after the next paragraph. The computer will process all wagering data and advance racers of bet tickets according to applicable drawn numerals, and determine race results.

For the public, the game proceeds as the flowchart in FIG. 1 together with drawn numerals shown in FIG. 1A. Players may anytime start to place bets, cash payoff and go home with cashable or non-cashable credit vouchers. Unless pause or stop has been regulated and announced ahead, it will go on indefinitely. Draw #n will grow accordingly. Any regulated stop of the game must allow every race in progress to proceed to the end. There are cashiers to handle cashable vouchers.

On a 1-race bet slip as shown in FIGS. 2 and 3, the player marks to select a number for the draw interval between two advancements. For example, 10 is selected and Draw #n assigned by the computer to start the race. Then Draw #(n+10) will be applied to the 2nd advancements, and Draw #(n+20) will be applied to the 3rd advancements. All immediately following Draws will be applied to subsequent advancements till three racers reach the finish line ending the race. Draw numbers of the first three advancements will be printed on the bet ticket as shown in FIGS. 2A and 3A.

On a multi-race bet slip as shown in FIGS. 4 and 5, the player marks to select a number for the draw interval between two races. For example, 20 is selected, and Draw #n will be assigned by the computer to start Race 1. Then (1) Draw #(n+4) will be applied to the 2nd advancements, Draw #(n+8) applied to the 3rd advancements, and immediately following Draws applied to subsequent advancements till three racers reach the finish line. (2) Draw #(n+20) will be applied to start Race 2, Draw #(n+20+4) applied to the 2nd advancements, Draw #(n+20+8) applied to the 3rd advancements, and immediately following Draws applied to subsequent advancements till three racers reach the finish line. (3) Draw #(n+40) will be applied to start Race 3, Draw #(n+40+4) applied to the 2nd advancements, Draw #(n+40+8) applied to the 3rd advancements, and immediately following Draws applied to subsequent advancements till three racers reach the finish line. All applicable Draw numbers for the first three advancements of a race will be printed on the bet ticket as shown in FIGS. 4A and 5A.

After each advancement of a race, bet ticket holders can obtain from any wagering machine (1) for sake of information, a display and or printout of racer locations. (2) for sake of convenience to place make-up bets between advancements, a display and or printout bet slip with racer locations.

DESCRIPTION OF PLACING BETS

There are 1-race and multi-race Win/Place/Show bets using a bet slip as shown in FIGS. 2 and 4 respectively. There are 1-race and multi-race Win/Exacta/Tricta bets using a bet slip as shown in FIGS. 3 and 5 respectively. A 3-race slip can be used for placing 2-race bets by simply marking no racer in Race 3. A bet ticket as shown in FIGS. 2A, 3A, 4A and 5A will be issued, when a bet slip is approved. All selected racers will be marked by "X". Any 1-race bet placed using a slip as shown in FIGS. 2A and 3A to start a game is 'bet before the start'.

Any wagering data printed on a bet ticket originated from a bet slip to start a game will be referred to as 'original'; otherwise, 'make-up'. In a 1-race game, any bet placed between the 1st and 2nd advancements is 'bet before 2nd advancement' as shown in FIGS. 2B and 3B, and any bet placed between the 2nd and 3rd advancements is 'bet before 3rd advancement' as shown in FIGS. 2C and 3C. Make-up bets will result in new independent tickets, except those using 'hanging' credits described below where revised tickets will be issued.

On a 1-race bet slip as shown in FIGS. 2 and 3, the player first marks "credit" or "payoff" as bet type. Marking "credit" will result in winning non-cashable credit without house edge, which can be used to place bets like cash. Marking "payoff" will result in winning cashable house edged payoff. On any bet slip, the player marks "amount per bet" or "total bet amount". If more than one per bet amount is marked, such as $1, $2 and $5, then the per bet amount will be their sum, that is $8. If more then one total amount is marked, such as $10 and $20, then the total will be their sum, that is $30. All bets on a slip have the same per bet amount.

1-race make-up bets between advancements will result in new independent tickets, which can be credit or payoff regardless of the bets before the start being which type.

A Win bet becomes winner if the selected racer finishes first. A Place bet becomes winner if the selected racer finishes first or second. A Show bet becomes winner if the selected racer finishes first, second or third. An Exacta bet becomes winner if both selected racers finish first and second in selected order. A Tricta bet becomes winner if all three selected racers finish first, second, and third in selected order. A multi-race bet is a combination of Race 1 bet, Race 2 bets and eventually a Race 3 bets, and becomes winner if it contains a winner in each race.

Note that in the following, * is multiplication sign, ^exponentiation sign. In a 1-race game, p denotes the winning probability of a bet. In a multi-race game, p1 denotes the winning probability of a Race 1 bet, p2 the winning probability of a Race 2 bet, and p3 the winning probability of a Race 3 bet. There are other winning probabilities pc1 and pc2, called carryover probabilities defined below. All of them are derivable using formulas presented in " CALCULATION OF PROBABILITIES". Note that p also denotes any applicable winning probability which can be any product of p1, p2, pc1, etc. as specified below.

The game of invention rules that 1-race $a credit bet winner of winning probability p earns non-cashable credit $a/p, which can be used like cash to place bets. 1-race $a payoff bet winner earns payoff ($a/p)*(100−e) %, with e to be set by the operator.

The game of invention rules that in a 2-race ticket of total amount $t with #Race1 selections in Race 1 and #Race2 selections in Race 2, a Race 1 winner causes the ticket to be hanging and earns credit ($t/#Race1)/p1. Then a Race 2 winner earns credit ($t/(#Race1*#Race2))/(p1*p2), resulting in payoff equal to this credit modified by (100−e) % with e to be set by the operator.

The game of invention rules that in a 3-race ticket of total amount $t with #Race1 selections in Race 1, #Race2 selections in Race 2, and #Race3 selections in Race 3, a Race 1 winner causes the ticket to be hanging and earns credit ($t/#Race1)/p1. Then a Race 2 winner causes the ticket to remain hanging and earns credit ($t/(#Race1*#Race2))/(p1*p2). Then a Race 3 winner earns credit ($t/(#Race1*#Race2*#Race3)/(p1*p2*p3), resulting in payoff equal to this credit modified by (100−e) % with e to be set by the operator.

Besides, the game allows hanging bet ticket holder to select percentage of hanging credit for placing bets like cash. If r % is selected, then the original bet value will be reduced to (100−r) %. Furthermore, the operator may use different house edges e to calculate payoff according to whether the bet is placed using non-cashable credit or not.

Up to this point e can be set arbitrarily by the operator, and the game can be played without hanging credit to be used like cash. But in the following let e be function e(x) defined as follows:

$$e(x)=2.5+x/4 \text{ for } 1\le x\le 10 \text{ (see FIG. 7).}$$

$$e(x)=4+(n+1)*(n/2+(x-10\hat{}n)/(9*10\hat{}n)) \text{ for } 10<x \text{ with integer n satisfying } 10\hat{}n<x\le 10\hat{}(n+1).$$

x in e(x) is the inverse of applicable winning probability p specified case by case below.

A multi-race bet/ticket containing a Race 1 winner becomes 'hanging' and earns non-cashable credit. The ticket holder doesn't need to take any action, but has the option to take advantage of it as follows: mark one "credit percentage", and either "new" or one or more Race 2 racers on the ticket as shown in FIGS. 4A or 5A. In the case of marking "new", the player will receive a revised ticket with original data and selected percentage together with a non-cashable voucher for the selected percentage hanging credit. This voucher can be used like cash to wager using any bet slip. But it bears a 'carryover' probability pc1 described below. Using non-cashable credit together with a new a bet slip will result in an independent ticket such that in the calculation of payoff, x in e(x) will be 1/(pc1*p) instead of 1/p. The case of marking no "new", but some Race 2 racers to make credit make-up bets without a new bet slip, will be explained below.

A hanging 3-race bet/ticket containing a Race 2 winner earns non-cashable credit and remains 'hanging'. The ticket holder doesn't need to take any action, but has the option to take advantage of it as follows: mark one "credit percentage", and either "new" or one or more Race 3 racers on the ticket as shown in FIGS. 4A or 5A or its revision mentioned above. In the case of marking "new", the player will receive a revised ticket with existing data and selected percentage together with a non-cashable voucher for the selected percentage hanging credit. This voucher can be used like cash to wager using any bet slip. But it bears a 'carryover' probability pc2 described below. Using non-cashable credit together with a new a bet slip will result in an independent ticket such that in the calculation of payoff, x in e(x) will be 1/(pc1*pc2*p) instead of 1/p. The case of marking no "new", but some Race 3 racers to make credit make-up bets without a new bet slip, will be explained below.

1-Race Win/Place/Show

To place 1-race Win/Place/Show using a bet slip as shown in FIG. 2, the player marks to select one or several spots 13, 14, and/or 15. Each selection counts one bet. Let 13(*i*) denote a Win bet on racer i, 14(*j*) denote a Place bet on racer j and 15(*k*) a Show bet on racer k. Let #13(*i*), #14(*j*) and #15(*k*) respectively be the number of 13(*i*), 14(*j*) and 15(*k*) selections. The total number of bets, denoted #Race1, is #13(*i*)+#14(*j*)+#15(*k*).

On a bet ticket as shown in FIGS. 2A, 2B or 2C, there can be maximal one Win winner, two Place winners and three Show winners.

$a bet winner earns credit $a/p or payoff ($a/p)*(100−e(x)) % according to its type.

1-Race Win/Exacta/Tricta

To place 1-race Win/Exacta/Tricta using a bet slip as shown in FIG. 3, the player marks to select one or several spots 13, 14, and/or 15. If one spot 15 is selected, then at least one spot 14 must be selected. If one spot 14 is selected, then at least one 13 must be selected. If there are only spots 13 being selected, then all bets are Win bets. If there are only spots 13 and 14 being selected, then all bets are Exacta bets. If there are spots 13, 14 and 15 being selected, then all bets are Tricta bets. In the case of Win bets, every selected racer i in spot 13 counts a bet. It is a 13(*i*) bet. In the case of Exacta bets, every selected racer i in spot 13 and every selected racer j in spot 14 with i≠j will be combined to form a 13(*i*)14(*j*) bet. If the player wants only specific combinations of selected i with j instead of all possible, then it is necessary to use separate slips. For example, using one bet slip, you can bet racers 1 or 2 finishing first and racers 3 or 4 finishing second, This results in four bets. If you just want one bet on racer 1 finishing first and racer 3 finishing second and another bet on racer 2 finishing first and racer 4 finishing second, then you need to use two bet slips to place them separately. In the case of Tricta bets, every selected racer i in spot 13 and every selected racer j in spot 14 and every selected racer k in spot 15 with i≠j≠k≠i will be combined to form a 13(*i*)14(*j*)15(*k*) bet. If the player wants only specific combinations of selected {i,j,k} instead of all possible, then it is necessary to use separate slips.

On a bet ticket as shown in FIGS. 3A, 3B or 3C, there will be at most one winner.

$a bet winner earns credit $a/p or payoff ($a/p)*(100−e(x)) % according to its type.

2-Race Win/Place/Show

To place 2-race Win/Place/Show using a bet slip as shown in FIG. 4, the player does first just as placing 1-race bets explained above to result in #Race1=#13(*i*)+#14(*j*)+#15(*k*) bets. Then marks to select one or several spots 23, 24, and/or 25. Let 23(*i*) denote a Win bet on racer i, 24(*j*) denote a Place bet on racer j and 25(*k*) a Show bet on racer k. Let #23(*i*), #24(*j*) and #25(*k*) respectively be the number of 23(*i*), 24(*j*) and 25(*k*) selections. There are #Race2=#23(*i*)+#24(*j*)+#25(*k*) Race 2 bets. In total there are #Race1*#Race2 2-race bets. No spots of {33, 34, 35} will be selected.

Let $t be the total bet amount.

Assume there is at least one Race 1 winner. Each winner earns non-cashable winner credit ($t/#Race1)/p1 and causes the bet to be hanging. Let $c1 be the total non-cashable credit and #Cr1 be the number of Race 1 winners. There is carryover probability pc1=($t/#Race1)*#Cr1/$c1. In the case of using $c1 by selecting one or more Race 2 Win/Place/Show racers, there will be credit make-up bets denoted 23'(*i*), 24'(*j*) and 25'(*k*). Let #23'(*i*), #24'(*j*) and #25'(*k*) respectively be the number of 23'(*i*), 24'(*j*) and 25'(*k*) selections. The total number of credit make-up bets is #23'(*i*)+#24'(*j*)+#25'(*k*), denoted #Race2cr. A revised ticket will be issued with selected make-up racers marked by "+" and all wagering data inclusive selected credit percentage, say, r2%. Each "+" bet amount is $c1*r2%/#Race2cr, while "X" is reduced to $c1*(100−r2) %/#Race2. This holds even the player takes no credit make-up bet action, that is r2=0 and no revised ticket.

At the end of Race 2, there is x=1/(pc1*p2) for e(x):

Each 23(*i*), 24(*j*), 25(*k*) winner earns credit $c1*(100−r2) %/(#Race2*p2), resulting in payoff [$c1*(100−r2) %/(#Race2*p2)]*(100−e(x)) %

Each 23'(*i*), 24'(*j*), 25'(*k*) winner earns credit $c1*r2%/(#Race2cr*p2), resulting in payoff [$c1*r2%/(#Race2cr*p2)]*(100−e(x)) %.

3-Race Win/Place/Show

To place 3-race Win/Place/Show using a bet slip as shown in FIG. 4, the player does first just as placing 2-race bets explained above to result in #Race1=#13(*i*)+#14(*j*)+#15(*k*) and #Race2=#23(*i*)+#24(*j*)+#25(*k*). Then marks to select one or several spots 33, 34, and/or 35. Let 33(*i*) denote a Win bet on racer i, 34(*j*) denote a Place bet on racer j and 35(*k*) a Show bet on racer k. Let #33(*i*), #34(*j*) and #35(*k*) respectively denote the number of 33(*i*), 34(*j*) and 35(*k*) selections. There are #Race3=#33(*i*)+#34(*j*)+#35(*k*) Race 3 bets. In total there are #Race1*#Race2*#Race3 3-race bets.

Let $t be the total bet amount.

Assume the ticket produces at least one Race 1 winner: Each winner earns non-cashable credit ($t/#Race1)/p1 and causes the bet to be hanging. Let $c1 be the total non-cashable credit and #Cr1 be the number of Race 1 winners. There is a carryover probability pc1=($t/#Race1)*#Cr1/$c1. In the case of using $c1 by selecting one or more Race 2 Win/Place/Show racers, there will be credit make-up bets denoted 23'(*i*), 24'(*j*) and 25'(*k*). Let #23'(*i*), #24'(*j*) and #25'(*k*) respectively be the number of 23'(*i*), 24'(*j*) and 25'(*k*) selections. Let #Race2cr denote the total number of credit make-up bets, which is #23'(*i*)+#24'(*j*)+#25'(*k*). Define #Race2all=#Race2+#Race2cr. A revised ticket will be issued with selected make-up racers marked by "+" and all wagering data inclusive selected credit percentage, say, r2%. Each "+" bet amount is $c1*r2%/#Race2cr, while "X" is reduced to $c1*(100−r2) %/#Race2. This holds even the player takes no credit make-up bet action, that is r2=0 and no revised ticket.

Assume the hanging ticket produces at least one Race 2 winner:

Each 23(*i*), 24(*j*), 25(*k*) winner earns non-cashable credit $c1*(100−r2) %/(#Race2*p2).

Each 23'(*i*), 24'(*j*), 25'(*k*) winner earns non-cashable credit $c1*r2%/(#Race2cr*p2).

Let $c2 be the total non-cashable credit and #Cr2 the number of Race 2 winners. There is a carryover probability pc2=($c1/#Race2all)*#Cr2/$c2. In the case of using $c2 by selecting one or more Race 2 Win/Place/Show racers, there will be credit make-up bets denoted 33'(*i*), 34'(*j*) and 35'(*k*). Let #33'(*i*), #34'(*j*) and #35'(*k*) respectively be the number of 33'(*i*), 34'(*j*) and 35'(*k*) selections. The total number of make-up bets is #33'(*i*)+#34'(*j*)+#35'(*k*), denoted #Race3cr. Define #Race3all=#Race3+#Race3cr. A revised ticket will be issued with make-up racers marked by "=" and all existing wagering data inclusive selected credit percentage, say, r3%. Each "=" bet amount is $c2*r3%/#Race3cr, while "X" is reduced to $c2*(100−r3) %/#Race3. This holds even the player takes no credit make-up bet action, that is r3=0 and no revised ticket.

At the end of Race 3, there is x=1/(pc1*pc2*p3) for e(x).

Each 33(*i*), 34(*j*), 35(*k*) winner earns credit $c2*(100−r3) %/(#Race3*p3), resulting in payoff [$c2*(100−r3) %/(Race3*p3)]*(100−e(x)) %

Each 33'(*i*), 34'(*j*), 35'(*k*) winner earns credit $c2*r3%/(#Race3cr*p3), resulting in payoff [$c2*r3%/(#Race3cr*p3)]*(100−e(x)) %.

2-Race Win/Exacta/Tricta

To place 2-race Win/Exacta/Tricta using a bet slip as shown in FIG. 5, the player does first just as placing 1-race bets explained above; then marks to select one or several spots 23, 24, and/or 25. If one spot 25 is selected, then at least one spot 24 must be selected. If one spot 24 is selected, then at least one 23 must be selected. If there are only spots 23 being selected, then all bets are Win bets. If there are only spots 23 and 24 being selected, then all bets are Exacta bets. If there are spots 23, 24 and 25 being selected, then all bets are Tricta bets. In the case of Win bets, every selected racer i in spot 23 counts a bet. It is a 23(*i*) bet. In the case of Exacta bets, every selected racer i in spot 23 and every selected racer j in spot 24 with i≠j will be combined to form a 23(*i*)24(*j*) bet. If the player wants only specific combinations of selected i with j instead of all possible, then it is necessary to use separate slips. In the case of Tricta bets, every selected racer i in spot 23 and every selected racer j in spot 24 and every selected racer k in spot 25 with i≠j≠k≠i will be combined to form a 23(*i*)24(*j*)25(*k*) bet. If the player wants only specific combinations of selected {i,j,k} instead of all possible, then it is necessary to use separate slips. All bets have the same per bet amount. Let #Race1 denote the number of Race 1 bets and $t the total bet amount.

Assume Race 1 produces a winner. It earns non-cashable credit $c1=($t/#Race1)/p1. Here is carryover probability pc1=p1. In the case of using $c2 by selecting one or more Race 2 make-up racer i to be 1st, racer j 2nd and racer k 3rd will be denoted by 23'(*i*), 2nd by 24'(*j*), 3rd by 25'(*k*). If the original Race 2 consists of Win bets then there will be make-up Win bets 23'(*i*). If the original Race 2 consists of Exacta bets then there will be make-up Exacta bets 23'(*i*)24(*j*), 23(*i*)24'(*j*) and 23'(*i*)24'(*j*) with i≠j . . . If the original Race 2 consists of Triata bets then there will be make-up Tricta bets 23'(*i*)24(*j*)25(*k*), 23(*i*)24'(*j*)25(*k*), 23(*i*)24(*j*)25'(*k*), 23'(*i*)24'(*j*)25(*k*) , 23'(*i*)24(*j*)25'(*k*), 23(*i*)24'(*j*)25'(*k*) and 23'(*i*)24'(*j*)25'(*k*) with i≠j≠k≠i. Let #Race2cr denote the total number of make-up bets and #Race2all=#Race2+#Race2cr. A revised ticket will be issued with make-up racers marked by "+" and all existing wagering data inclusive selected credit percentage, say, r3%. Each make-up bet amount is $c1*r2%/#Race2cr, while original one is reduced to $c1*(100−r2)%/#Race2. This holds even the player takes no credit make-up bet action, that is r2=0 and no revised ticket At the end of Race 2, there is x=1/p1*p2 for e(x):

Original bet winner earns credit ($c1*(100−r2%))/(#Race2*p2), resulting in payoff [($c1*(100−r2%))/(#Race2*p2)]*(100−e(x)) %.

Make-up bet winner earns credit ($c1*r2%)/(#Race2cr*p2), resulting in payoff [($c1*r2%)/(#Race2cr*p2)]*(100−e(x)) %.

3-Race Win/Exacta/Tricta

To place 3-race Win/Exacta/Tricta using a bet slip as shown in FIG. 5, the player does first just as placing 2-race bets explained above; then marks to select spots 33, 34, and/or 35. If one spot 35 is selected, then at least one spot 34 must be selected. If one spot 34 is selected, then at least one spot 33 must be selected. If there are only spot 33 being selected, then all bets are Win bets. If there are only spots 33 and 34 being selected, then all bets are Exacta bets. If there are spots 33, 34 and 35 being selected, then all bets are Tricta bets. In the case of Win bets, every selected racer i in spot 33 counts a bet. It is a 33(*i*) bet. In the case of Exacta bets, every selected racer i in spot 33 and every selected racer j in spot 34 with i≠j will be combined to form a 33(*i*)34(*j*) bet. If the player wants only specific combinations of selected i with j instead of all possible, then it is necessary to use separate slips. If the player wants only specific combinations of selected i with j instead of all possible, then it is necessary to use separate slips. In the case of Tricta bets, every selected racer i in spot 33 and every selected racer j in spot 34 and every selected racer k in spot 35 with i≠j≠k≠i will be combined to form a 33(*i*)34(*j*)35(*k*) bet. If the player wants only specific combinations of selected {i,j,k} instead of all possible, then it is necessary to use separate slips. All bets have the same per bet amount. Let #Race1 denote the number of Race 1 bets and $t the total bet amount. A revised ticket will be issued with selected make-up racers marked by "+" and all wagering data inclusive selected credit percentage.

Assume Race 1 produces a winner. It earns non-cashable credit $c1=($t/#Race1)/p1. Here is carryover probability pc1=p1. In the case of using $c1 by selecting one or more Race 3 make-up racer i to be 1st, racer j 2nd and racer k 3rd will be denoted by 23'(*i*), 2nd by 24'(*j*), 3rd by 25'(*k*). If the original Race 2 consists of Win bets then there will be make-up Win bets 23'(*i*). If the original Race 2 consists of Exacta bets then there will be make-up Exacta bets 23'(*i*)24(*j*), 23(*i*)24'(*j*) and 23'(*i*)24'(*j*) with i≠j . . . If the original Race 2 consists of Triata bets then there will be make-up Tricta bets 23'(*i*)24(*j*)25(*k*), 23(*i*)24'(*j*)25(*k*), 23(*i*)24(*j*)25'(*k*), 23'(*i*)24'(*j*)25(*k*) , 23'(*i*)24(*j*)25'(*k*), 23(*i*)24'(*j*)25'(*k*) and 23'(*i*)24'(*j*)25'(*k*) with i≠j≠k≠i. Let #Race2cr denote the total number of make-up bets and #Race2all=#Race2+#Race2cr. A revised ticket will be issued with make-up racers marked by "+" and all existing wagering data inclusive selected credit percentage, say, r2%. This holds even the player takes no credit make-up bet action, that is r2=0 and no revised ticket At the end of Race 2:

Original Race 2 winner earns credit $c2=($c1*(100−r2%))/(#Race2*p2).

Make-up Race 2 winner earns credit $c2=($c1*r2%)/(#Race2cr*p2).

In case there is one Race 2 winner, the bet remains hanging. Here is carryover probability pc2=p2. In the case of using $c2 by selecting one or more Race 3 make-up racer i to be 1st, racer j 2nd and racer k 3rd will be denoted by 33'(*i*), 2nd by 34'(*j*), 3rd by 35'(*k*). If the original Race 3 consists of Win bets then there will be make-up Win bets 33'(*i*). If the original Race 3 consists of Exacta bets then there will be make-up Exacta bets 33'(*i*)34(*j*), 33(*i*)34'(*j*) and 33'(*i*)34'(*j*) with i≠j . . . If the original Race 3 consists of Triata bets, then there will be make-up Tricta bets 33'(*i*)34(*j*)35(*k*), 33(*i*)34'(*j*)35(*k*), 33(*i*)34(*j*)35'(*k*), 33'(*i*)34'(*j*)35(*k*), 33'(*i*)34(*j*)35'(*k*), 33(*i*)34'(*j*)35'(*k*) and 33'(*i*)34'(*j*)35'(*k*) with i≠j≠k≠i. Let #Race3cr denote the total number of make-up bets and #Race3all=#Race3+#Race3cr. Let r3% be selected credit percentage. A revised ticket will be issued with selected make-up racers marked by "=" and all wagering data inclusive selected credit percentage, say, r3%. Each make-up bet amount is $c2*r3%/#Race3cr, while original one is reduced to $c2*(100−r3)%/#Race3. This holds even the player takes no credit make-up bet action, that is r3=0 and no revised ticket.

At the end of Race 3, there is x=1/p1*p2*p3 for e(x):

Original Race 3 winner earns credit ($c2*(100−r3%))/(#Race3*p3), resulting in payoff [($c2*(100−r3%))/(#Race3*p3)]*(100−e(x)) %.

Make-up Race 3 winner earns credit ($c2*r3%)/(#Race3cr*p3), resulting in payoff [($c2*r3%)/(#Race3cr*p3)]*(100−e(x)) %.

DESCRIPTION OF THE AUTOMATIC VERSION

Same playing surface but no scheduled draws or draw intervals or draw numbers.

To play the automatic game one needs either a video game machine or a personal computer equipped with made-to-order software inclusive a TIMER-function random number generator. Each player opens an account or will be assigned an account. Every action of an account holder will be filed automatically so that there may be no printer to provide an immediate printout.

The computer is connected to a pointing device or touch screen monitor so that the action 'select' below can be executed by the pointing device or finger touching. Selecting any icon/item on the display screen will either highlight it or result in a new display. Selecting a highlighted item is to cancel that selection. All figures printed on paper are supposed to be black, white and gray. Now, on a monitor they can be quite colorful.

The game starts with the display of a bet slip as shown in FIGS. 2 or 4 with additional icons/items named "Alternative slip", "Ticket", and "Account". But there is no draw interval selection.

Selecting "Alternative slip" will switch to a Win/Exacta/Tricta bet slip as shown in FIGS. 2 or 4 if the displayed one is Win/Place/Show, or conversely.

The player places bets on screen just as in the non-automatic game. Then selects "Ticket" to submit. If the submitted slip is incomplete or contains error, there will be a message like 'Incomplete! Please select per bet amount', requiring the player to make amendment. If the submission is approved, a bet ticket as shown in FIGS. 2A, 3A, 4A or 5A with additional icons "Go back", "Go ahead".

Selecting "Go back" will allow the player to make changes on the submitted bet slip.

Selecting "Go ahead" will result in an official bet ticket with a ticket # and icons "Bet slip", "Run", "Account".

Selecting "Bet slip" will display a blank one to take bet.

Selecting "Run" will cause one draw of random numbers so that if it is a 1-race ticket, all racers will advance accordingly, if it is a multi-race ticket, all racers of the foremost unfinished race will advance accordingly and will be shown on monitor display.

Selecting "Account' will result in a display as shown in FIG. 6. It shows the available balance, and all betting activities since the opening of that account.

Here the player can click "Ticket # so and so" to view that ticket and to run the race on that ticket or to place credit bets just as in the non-automatic game.

Selecting "Bet slip" is to require a new bet slip while "Exit" to end the game.

CALCULATION OF PROBABILITIES

Let g,h,i,j,k,l,m,n,s,u,x,y,z be natural numbers. We call the action of generating a random number from 1 to 6 'roll'.

A (n,s)-sequence is a sequence of n rolled numbers whose sum is s. For example, (2,5)-sequences are 1 4, 2 3, 3 2 or 4 1; (3,10)-sequences are 1 3 6, 1 4 5, 1 5 4, 1 6 3, 2 2 6, 2 3 5, 2 4 4, 2 5 3, 2 6 2, . . . 6 1 3, 6 2 2 or 6 3 1.

Let R(n,s) denote the total number of all possible (n,s)-sequences.

Obviously, R(1,1)=R(1,2)= . . . =R(1,6)=1 and R(1,s)=0 for s>6

In exactly 2 rolls we have s=2 by 1 1 only, and s=12 by 6 6 only; thus,

R(2,2)=R(2,12)=1

In exactly 2 rolls we have s=3 by 1 2 or 2 1, s=11 by 5 6 or 6 5, thus

R(2,3)=R(2,11)=2

In exactly 2 rolls we have s=4 by 1 3 or 2 2 or 3 1, s=10 by 4 6, 5 5 or 6 4, thus

R(2,4)=R(2,10)=3

Similarly we have

R(2,5)=R(2,9)=4

R(2,6)=R(2,8)=5

R(2,7)=6

R(2,0)=R(2,s)=0 for s>12

For n>2 we derive a recursion formula as follows:

Every (n,s)-sequence is a one-more-roll extension of a (n−1,k)-sequence where k is between s−6 and s−1. Thus, $$R(n,s)=R(n-1,s-1)+R(n-1,s-2)+R(n-1,s-3)+\ldots+R(n-1,s-6)$$

Replacing s by s−1 we have $$R(n,s-1)=R(n-1,s-2)+R(n-1,s-3)+R(n-1,s-4)+\ldots+R(n-1,s-7)$$

Together

R(n,s)=R(n,s−1)+R(n−1,s−1)−R(n−1,s−7), a recursion formula.

Note that R(n,s)=0 for s<n or 6n<s.

By the above formula we get all R(n,s) one by one as follows:

$$R(3,3)=0+R(2,2)-0=0+1-0=1$$

$$R(3,4)=R(3,3)+R(2,3)-0=1+2-0=3$$

$$R(3,5)=R(3,4)+R(2,4)-0=3+3-0=6$$

. . .

$$R(3,10)=R(3,9)+R(2,9)-R(2,3)=25+4-2=27$$

. . .

$$R(3,18)=R(3,17)+R(2,17)-R(2,11)=3+0-2=1$$

$$R(4,4)=0+R(3,3)-0=0+1-0=1$$

$$R(4,5)=R(4,4)+R(3,4)-0=1+3-0=4$$

. . .

$$R(4,12)=R(4,11)+R(3,11)-R(3,5)=104+27-6=125$$

. . .

$$R(4,24)=R(4,23)+R(3,23)-R(3,17)=4+0-3=1$$

$$R(5,5)=0+R(4,4)-0=0+1-0=1$$

$$R(5,6)=R(5,5)+R(4,5)-0=1+4-0=5$$

etc.

A stand-by (n,s)-sequence is a sequence of n rolled numbers whose sum is between s−5 and s.

Examples: A stand-by (3,9)-sequence is x y z such that 4<=x+y+z<=9. It can be 1 1 2, 1 1 3, . . . , 1 1 6, 1 2 1, . . . , 1 2 6, . . . , 1 6 2, . . . , 2 1 1, . . . , 2 6 1, . . . , 3 1 1, . . . , 3 5 1, 4 1 1, . . . , 4 4 1, 5 1 1, . . . , 5 3 1, 6 1 1, 6 1 2, 6 2 1.

A winning (n,s)-sequence is a sequence of n rolled numbers whose sum is between s and s+5 . . .

Examples: A winning (4,14)-sequence is x y z u such that 14<=x+y+z+u<=19. It can be 1 1 6 6, 1 2 5 6, 1 2 6 5, 1 2 6 6, 1 3 4 6, . . . 1 3 6 6, 1 4 3 6, . . . 1 4 6 6, 1 5 2 6 . . . 1 5 6 6 . . . 1 6 1 6, . . . 1 6 6 6, 2 1 5 6, 2 6 5 6, 3 1 4 6, . . . 3 6 4 6, 4 1 3 6, . . . 4 6 3 4, 5 1 2 6, . . . , 5 6 2 6, 6 1 1 6, . . . 6 6 1 6.

Every roll extends a sequence. By a one-more-roll extension, all 6 stand-by (n−1,s−1)-sequences will result in a winning (n,s)-sequence; but only 5 stand-by (n−1,s−2)-sequences, 4 stand-by (n−1,s−3)-sequences, 3 stand-by (n−1,s−4)-sequences, 2 stand-by (n−1,s−5)-sequences, and just one stand-by (n−1,s−6)-sequence will result in winning (n,s)-sequences. Thus, the probability of any stand-by sequence to result in a winning (n,s)-sequence, denoted P(n,s), is 6*R(n−1,s−1)+5*R(n−1,s−2)+4* . . . +3* . . . +2* . . . +R(n−1,s−6) divided by 6*[R(n−1,s−1)+R(n−1,s−2)+ . . . + . . . + . . . +R(n−1,s−6)].

Consider now the case of playing alone, roll by roll, to get a winning (n,s)-sequence. Let ch(n,s) be the chance function stating your chance to enter the n-th roll. W(n,s)=ch(n,s)*P(n,s) will be the probability to win exactly in the n-th roll. Roll 1: ch(1,s)=1, W(1,s)=ch(1,s)*P(1,s). Roll 2: ch(2,s)=ch(1,s)−W(1,s), W(2,s)=ch(2,s)*P(2,s)=[ch(1,s)−W(1,s)]*P(2,s). Roll 3: ch(3,s)=ch(1,s)−W(1,s)−W(2,s), etc.

Example: The case of s=8.

Roll 1: ch(1,8)=1.

P(1,8)=0.

W(1,8)=ch(1,8)*P(1,8)=0.

Roll 2: ch(2,8)=ch(1,8)−W(1,8)=1.

P(2,8)=[6*R(1,7)+5*R(1,6)+4* . . . +3* . . . +2*R(1,3)+R(1,2)]/6*[R(1,7)+R(1,6)+ . . .+R(1,3)+R(1,2)]=15/6^2.

W(2,8)=ch(2,8)*P(2,8)=15/6^2.

Roll 3: ch(3,8)=ch(2,8)−W(2,8)=1−W(1,8)−W(2,8)=21/6^2.

P(3,8)=[6*R(2,7)+5*R(2,6)+4* . . . +3* . . . +2*R(2,3)+R(2,2)]/6*[R(2,7)+R(2,6)+ . . . +R(2,3)+R(2,2)]=91/126.

W(3,8)=ch(3,8)*P(3,8)=91/6^3.

Roll 4: ch(4,8)=ch(3,8)−W(3,8)=1−W(1,8)−W(2,8)−W(3,

8)=35/6^3.

P(4,8)=[6*R(3,7)+5*R(3,6)+4* . . . +3* . . . +2*R(3,3)+R(3,2)]/6*[R(3,7)+R(3,6)+ . . . +R(3,3)+R(3,2)]=5/6.

W(4,8)=ch(4,8)*P(4,8)=175/6^4.

Roll 5: ch(5,8)=ch(4,8)−W(4,8)=1−W(1,8)−W(2,8)− . . . −W(4,8)=35/6^4.

P(5,8)=[6*R(4,7)+5*R(4,6)+4* . . . +3* . . . +2*R(4,3)+R(4,2)]/6*[R(4,7)+R(4,6)+ . . . +R(4,3)+R(4,2)]=9/10.

W(5,8)=ch(5,8)*P(5,8)=189/6^5.

Roll 6: ch(6,8)=ch(5,8)−W(5,8)=1−W(1,8)−W(2,8)− . . . −W(5,8)=21/6^5.

P(6,8)=[6*R(5,7)+5*R(5,6)+4* . . . +3* . . . +2*R(5,3)+R(5,2)]/6*[R(5,7)+R(5,6)+ . . . +R(5,3)+R(5,2)]=17/18.

W(6,8)=ch(6,8)*P(6,8)=119/6^6.

Roll 7: ch(7,8)=ch(6,8)−W(6,8)=1−W(1,8)−W(2,8)− . . . −W(6,8)=7/6^6.

P(7,8)=[6*R(6,7)+5*R(6,6)+4* . . . +3* . . . +2*R(6,3)+R(6,2)]/6*[R(6,7)+R(6,6)+ . . . +R(6,3)+R(6,2)]=41/42.

W(7,8)=ch(7,8)*P(7,8)=41/6^7.

Roll 8: ch(8,8)=ch(7,8)−W(7,8)=1−W(1,8)−W(2,8)− . . . −W(7,8)=1/6^7.

P(8,8)=[6*R(7,7)+5*R(7,6)+4* . . . +3* . . . +2*R(7,3)+R(7,2)]/6*[R(7,7)+R(7,6)+ . . . +R(7,3)+R(7,2)]=1.

W(8,8)=ch(8,8)*P(8,8)=1/6^7.

Since ch(8,8)−W(8,8)=1−W(1,8)−W(2,8)− . . . −W(8,8)=0, no further roll can win.

Now our race game is that Racer i is playing with competition to get a winning (n, Tr(i))-sequence where Tr(i) denotes the track length of racer i, i.e., the number of advancement spots from start to finish. There are P(n, Tr(i)) just as explained above. Let A(n,i) denote the probability of Racer i finishing Tr(i) first in competition in exactly n rolls.

$$A(n,i)=P(n,Tr(i))*ch(n,i)$$

where ch(n,i), the chance of reaching the n-th roll, is equal to [1-all A(n,i) listed ahead, if any] ordered as follows: The first n is 1 and the first i is 1. Let i run from 1 to 9, then increase n by one and run another cycle of i as before and so on till n=g with ch(n,i) being immaterial. We'll talk about some specific g below.

The probability of Racer i finishing first is $$W(i)=A(1,i)+A(2,i)+A(3,i)+\ldots+A(g,i)$$

Let Bm(n,i,j) denote the probability of Racer j finishing Tr(j) in competition in exactly n rolls after Racer i finishing first in exactly m rolls.

$$Bm(n,i,j)=P(n,Tr(i))*ch(n,i,j)$$

where ch(n,i,j), the chance of Racer j reaching the n-th roll, is equal to [1-all Bm(n,i,j) listed ahead, if any] ordered as follows: The first n is m and the first j is i+1 which is 1 if i=9. Let j run from i+1 to 9 and then from 1 to i−1, then increase n by one and run another cycle of j as before and so on till n=g.

Note that, writing computer program to calculate, one has to set Bm(n,i,j)=0 when it is so, namely for i=j for n=m and j<i The probability of Racer i finishing first and Racer j second is $$\begin{aligned}X(i,j)=&A(1,i)*[B1(1,i,j)+B1(2,i,j)+\ldots+B1(g,i,j)]+\\&A(2,i)*[B2(2,i,j)+B2(3,i,j)+\ldots+B2(g,i,j)]+A(3,i)\\&*[B3(3,i,j)+B3(4,i,j)+\ldots+B3(g,i,j)]+\ldots+A(g,i)\\&*Bg(g,i,j)\end{aligned}$$

The probability of Racer j finishing first or second is $$PB(j)=W(j)+X(1,j)+X(2,j)+X(3,j)+\ldots+X(9,j)$$

Let Cm(n,i,j,k) be the probability of Racer k finishing Tr(k) in competition in exactly n rolls after Racer i has finished first in m rolls or less and Racer j finishing second in exactly m rolls.

$$Cm(n,i,j,k)=P(n,Tr(i))*ch(n,i,j,k)$$

where ch(n,i,j,k), the chance of Racer k reaching the n-th roll, is equal to [1-all Cm(n,i,j,k) listed ahead, if any] ordered as follows: The first n is m and the first k is j+1 which is 1 if j=9. Let k run from j+1 to 9 and then from 1 to j−1, then increase n by one and run another cycle of k as before and so on till n=g.

Note that, writing computer program to calculate, one has to set Cm(n,i,j,k)=0 when it is so, namely for i=j or i=k or j=k for n=m and i<j and k<j for n=m and j<i for n=m and j=1 for n=m+1 and k<j<i for n=m+1 and i=1 and k<j

The probability of Racers i, j, k finishing first, second and third respectively is $$\begin{aligned}T(i,j,k)=&A(1,i)*\{B1(1,i,j)*[C1(1,i,j,k)+C1(2,i,j,\\&k)+\ldots+C1(g,i,j,k)]+B1(2,,i,j)*[C2(2,i,j,k)+C2\\&(3,i,j,k)+\ldots+C2(g,i,j,k)]+B1(3,i,j)*[C3(3,i,j,k)+\\&C3(4,i,j,k)+\ldots]+\ldots+B1(g,i,j)*Cg(g,i,j,k)\}+A\\&(2,i)*\{B2(2,i,j)*[C2(2,i,j,k)+C2(3,i,j,k)+\ldots+C2\\&(g,i,j,k)]+B2(3,i,j)*[C3(3,i,j,k)+C3(4,i,j,\\&k)+\ldots+C3(g,i,j,k)]+B2(4,i,j)*[C4(4,i,j,k)+C4(5,\\&i,j,k)+\ldots]+\ldots+B2(g,i,j)*Cg(g,i,j,k)\}+A\\&(3,i)*\{B3(3,i,j)*[C3(3,i,j,k)+\ldots]+\ldots+\\&B3\ldots\}+A(4,i)*\{B4(4,i,j)*\ldots+\ldots\}+\ldots+A\\&(g,i)*Bg(g,i,j)*Cg(g,i,j,k)\end{aligned}$$

The probability of Racer k finishing first, second or third is $$\begin{aligned}S(k)=&P(k)+T(1,1,k)+T(1,2,k)+T(1,3,k)+\ldots+T(1,9,k)+\\&T(2,1,k)+T(2,2,k)+T(2,3,k)+\ldots+T(2,9,k)+T(3,1,\\&k)+\ldots+\ldots+\ldots+T(9,8,k)+T(9,9,k)\end{aligned}$$

Note that the QBasic program File 91416 in U.S. Pat. No. 5,795,226 can be adjusted by resetting Tr(i) and other parameter values to calculate any probabilities of the above formulae. Set Tr(i)=0 to scratch Racer i. P(n,l) in U.S. Pat. No. 5,795,226 was defined slightly different from P(n,s) here, but all numerical values P(n,l) in subroutine SUB calc2P are exactly P(n,s). Because the letter l is hardly distinguishable from the number 1, it has been replaced with s here.

The following is to explain why the calculation needs no more than 7 rolls under two assumptions: 1. Tr(i)<=16. 2. The race ends when three racers finish. Here, ch(n,i), ch(n,i,j), and ch(n,i,j,k) are all immaterial for n>=g=7 for the following reason. The summation of R(7,7) to R(7,42) is 6^7=279936. Those of value less than 16 are: R(7,7)=1, R(7,8)=7, R(7,9)=28, R(7,10)=84, R(7,11)=210, R(7,12)=462, R(7,13)=917, R(7,14)=1667, R(7,15)=2807. Their sum is 6183. Thus, after seven rolls the chance of a racer having moved less than 16 spots is 6183/279936<1/40. The chance of a race still having finished after 7 rolls is less than (1/40)^7 (the exponent 7 stands for racers not for rolls). This means, using g=7, the probability calculation error is less than one billionth. Although today's computer can easily go on to g being equal to the maximal Tr(i), it makes no sense to pursuit accuracy higher than one billionth.

NUMERICAL EXAMPLES

The set-ups of racecourses as shown in FIGS. 2A and 4A are generated from a QBasic program using (INT(1000000*RND)) MOD(4)+13, while advancements as shown in FIGS. 2D and 4B using (INT(1000000*RND))

MOD(6)+1. 13 is selected to make a race need at least 3 Draws to end so that make-up bets are available before 3rd advancement. The wagering strategy is simply to avoid long shots based on WIN probabilities. The selection of 'payoff' or 'credit' is at random.

1-Race Win/Place/Show

The 1-race ticket as shown in FIG. 2A: Based on the order of top six WIN probabilities being 1-3-9-6-2-4 (FIG. 8A, Track: 15 16 14 15 15 14 16 15 13.), bet $2 payoff Win/Place/Show on {#1,#3,#9,#6}, Place/Show on #2 and Show on #4, in total 15 bets, $a=$2, total $30.

Assume finishing order 3-6-4, see FIG. 8A:

13(3) earns credit $9.76 or payoff $9.40 where p=0.20501718 and e(x)=4.88

14(3) earns credit $5.38 or payoff $5.20 where .p=0.37198853 and e(x)=2.68.

15(3) earns credit $3.72 or payoff $3.62 where p=0.53737468 and e(x)=1.86.

14(6) earns credit $8.98 or payoff $8.66 where p=0.22269434 and e(x)=4.49.

15(6) earns credit $6.08 or payoff $5.88 where p=0.32851860 and e(x)=3.04.

15(4) earns credit $5.64 or payoff $5.46 where p=0.35450968 and e(x)=2.82.

Total payoff $38.22 or alternatively credit $39.56.

The 1-race bet before 2nd advancement ticket as shown in FIG. 2B: Based on the order of top six WIN probabilities being 3-1-9-2-6-4 (FIG. 8B, Track: 12 13 10 12 13 11 13 13 10), bet $2 credit Win/Place/Show on {#3,#1,#9,#2}, Place/Show on #6 and Show on #4, in total 15 bets, $30.

13(3) earns credit $6.24 or payoff $6.04 where p=0.32068744 and e(x)=3.28.

14(3) earns credit $3.74 or payoff $3.62 where p=0.53544164 and e(x)=2.97.

15(3) earns credit $2.94 or payoff $2.86 where p=0.68093830 and e(x)=2.87.

14(6) earns credit $9.24 or payoff $8.90 where p=0.24655814 and e(x)=3.65.

15(6) earns credit $5.88 or payoff $5.70 where p=0.33970699 and e(x)=3.24.

15(4) earns credit $5.52 or payoff $5.34 where p=0.36284953 and e(x)=3.19.

Total credit $33.56 or alternatively payoff $32.46.

The 1-race bet before 3rd advancement ticket as shown in FIG. 2C: Based on the order of top six WIN probabilities being 3-6-1-5-4-2 (FIG. 8C, Track: 10 12 6 9 8 6 10 11 8), bet $2 payoff Win/Place/Show on {#3,#6,#1,#5}, Place/Show on #4 and Show on #2, in total 15 bets, $30.

13(3) earns credit $3.68 or payoff $3.56 where p=0.54458159 and e(x)=2.96.

14(3) earns credit $2.76 or payoff $2.68 where p=0.72505695 and e(x)=2.84.

15(3) earns credit $2.48 or payoff $2.40 where p=0.80675584 and e(x)=2.81.

14(6) earns credit $4.68 or payoff $4.54 where p=0.42776373 and e(x)=3.08.

15(6) earns credit $3.16 or payoff $3.06 where p=0.63374454 and e(x)=2.89.

15(4) earns credit $5.52 or payoff $5.34 where p=0.36295882 and e(x)=3.19.

Total payoff $21.58 or alternatively credit $22.28.

Incidentally, all 3 tickets produce maximum 6 winners, but the bet before 3rd advancement a loss, and result in payoff $38.22+$21.58 and credit $32.46.

The following (A) and (B) are to show some other possible outcomes.

(A) Assume finishing order 2-9-6:

The ticket of FIG. 2A: See FIG. 8A

14(2) earns credit $8.86 or payoff $8.54 where p=0.22581133 and e(x)=3.61.

15(2) earns credit $5.10 or payoff $4.93 where p=0.39268690 and e(x)=3.14.

14(9) earns credit $8.38 or payoff $8.09 where p=0.23841733 and e(x)=3.55.

15(9) earns credit $6.18 or payoff $5.98 where p=0.32367918 and e(x)=3.27.

15(6) earns credit $6.08 or payoff $5.89 where p=0.32851860 and e(x)=3.26.

Total payoff $33.43 or alternatively credit $34.50.

The ticket of FIG. 2B: See FIG. 8B

13(2) earns credit $19.60 or payoff $18.64 where p=0.10201421 and e(x)=4.95.

14(2) earns credit $8.70 or payoff $8.38 where p=0.23014885 and e(x)=3.59.

15(2) earns credit $5.06 or payoff $4.89 where p=0.39579657 and e(x)=3.13.

14(9) earns credit $8.86 or payoff $8.55 where p=0.22565275 and e(x)=3.61.

15(9) earns credit $6.20 or payoff $5.99 where p=0.32293954 and e(x)=3.27.

15(6) earns credit $5.88 or payoff $5.70 where p=0.33970699 and e(x)=3.24.

Total credit $54.30 or alternatively payoff $52.15.

The ticket of FIG. 2C: See FIG. 8C

15(2) earns credit $15.24 or payoff $14.56 where p=0.13131382 and e(x)=4.40.

15(6) earns credit $3.16 or payoff $3.06 where p=0.63374454 and e(x)=2.89.

Total payoff $17.62 or alternatively credit $18.40.

In this case, 3 tickets result in payoff $33.43+$52.15 and credit $17.62.

(B) Assume finishing order 5-3-1:

The ticket of FIG. 2A: See FIG. 8A

14(3) earns credit $5.38 or payoff $5.20 where p=0.37198853 and e(x)=2.68.

15(3) earns credit $3.72 or payoff $3.62 where p=0.53737468 and e(x)=1.86.

15(1) earns credit $4.20 or payoff $4.06 where p=0.47724363 and e(x)=3.02.

Total payoff $12.88 or alternatively credit $13.30.

The ticket of FIG. 2B: See FIG. 8B

14(3) earns credit $3.74 or payoff $3.62 where p=0.53544164 and e(x)=2.97.

15(3) earns credit $2.94 or payoff $2.86 where p=0.68093830 and e(x)=2.87.

15(1) earns credit $4.12 or payoff $4.00 where p=0.48611856 and e(x)=3.01.

Total credit $10.80 or alternatively payoff $10.48.

The ticket of FIG. 2C: See FIG. 8C

13(5) earns credit $35.34 or payoff $33.52 where p=0.05658321 and e(x)=5.17.

14(5) earns credit $7.88 or payoff $7.62 where p=0.25351435 and e(x)=3.49.

15(5) earns credit $4.96 or payoff $4.82 where p=0.40251814 and e(x)=3.12.

14(3) earns credit $2.76 or payoff $2.68 where p=0.72505695 and e(x)=2.84.

15(3) earns credit $2.48 or payoff $2.40 where p=0.80675584 and e(x)=2.81.

15(1) earns credit $5.96 or payoff $5.76 where p=0.36295882 and e(x)=3.19.

Total payoff $56.80 or alternatively credit $59.48.

In this case, 3 tickets result in payoff $12.88+$56.80 and credit $10.48.

1-Race Win/Exacta/Tricta

The 1-race Tricta ticket as shown in FIG. 3A: Based on the order of top six WIN probabilities being 1-3-9-6-2-4, (FIG. 8A, Track: 15 16 14 15 15 14 16 15 13.), bet $0.50 credit 1st/2nd/3rd on {#1,#3,#9,#6}, 2nd/3rd on #2 and 3rd on #4, in total 64 bets, $32.

The 1-race bet before 2nd advancement Tricta ticket as shown in FIG. 3B. Based on the order of top six WIN probabilities being 3-1-9-2-6-4 (FIG. 8B, Track: 12 13 10 12 13 11 13 13 10), bet $0.50 payoff 1st/2nd/3rd on {#3,#1,#9,#2}, 2nd/3rd on #6 and 3rd on #4, in total 64 bets, $32.

The 1-race bet before 3rd advancement Tricta ticket as shown in FIG. 3C. Based on the order of top six WIN probabilities being 3-6-1-5-4-2 (FIG. 8C, Track: 10 12 6 9 8 6 10 11 8), bet $0.50 credit 1st/2nd/3rd on {#3,#6,#1,#5}, 2nd/3rd on #4 and 3rd on #2, in total 64 bets, $32.

Assume finishing order 3-6-4:

Tickets of FIGS. 3A: See FIG. 9A

13(3)14(6)15(4) earns credit $a/p=$211.32 where p=0.00236604.

Tickets of FIGS. 3B: See FIG. 9B

13(3)14(6)15(4) earns payoff $a/p*(100−e(x)) %=$146.12 where p=0.00315777 and e(x)=7.72.

Tickets of FIGS. 3C: See FIG. 9C

13(3)14(6)15(4) earns credit $a/p=$27.23 where p=.01836686.

Again some other possible outcomes.

(A) Assume finishing order 2-9-6, see FIG. 9D:

Tickets of FIGS. 3A and 3C produce no winner, while that of FIG. 3B:

13(2)14(9)15(6) earns payoff ($a/p)*(100−e(x)) %=$10257.36 where p=0.00004154 and e(x)=14.78

(B) Assume finishing order 5-3-1, see FIG. 9D:

Tickets of FIGS. 3A and 3B produce no winner, while that of FIG. 3C:

13(5)14(3)15(1) earns credit $a/p=$1,250,000 where p=0.00000040.

Multi-race Win/Place/Show

The multi-race ticket of FIG. 4A. In Race 1, based on the order of top six WIN probabilities being 1-3-9-6-2-4 (see FIG. 8A, Track: 15 16 14 15 15 14 16 15 13.), bet $0.10 Win/Place/Show on {#1,#3,#9,#6}, Place/Show on #2 and Show on #4. Thus, #Race1=15. In Race 2, based on the order of top four WIN probabilities being 1-2-3-4 (see FIG. 10: Track: 14 16 13 15 15 0 16 15 16), bet Win/Place/Show on {#1,#2}, Place/Show on #3 and Show on #4. Thus, #Race2=9. In Race 3, based on the order of top four WIN probabilities being 1-6-4-2 (see FIG. 11: Track: 15 15 0 14 16 13 0 16 14 13), bet Win/Place/Show on {#1,#6}, Place/Show on #4 and Show on #2. Thus, #Race3=9. In total, #Race1*#Race2*#Race3=15*9*9=1215 bets, $t=$121.50.

Assume finishing order 3-6-4:

13(3) earns credit ($t/#Race1)/p1=$39.51 where p1=0.20501718.

14(3) earns credit ($t/#Race1)/p1=$21.77 where p1=0.37198853.

15(3) earns credit ($t/#Race1)/p1=$15.06 where p1=0.53737468.

14(6) earns credit ($t/#Race1)/p1=$36.32 where p1=0.22269434.

15(6) earns credit ($t/#Race1)/p1=$24.70 where p1=0.32851860.

15(4) earns credit ($t/#Race1)/p1=$22.85 where p1=0.35450968.

Total credit from Race 1 is $c1=$160.21. #Cr1=6.

Based on the order of top six WIN probabilities being 1-2-3-4-5-8 (see FIG. 10), bet make-up Win on {#3,#4}, Place on {#4,#5}, Show on {#5,#8}. Thus, #Race2cr=6. Since the ratio of #Race2cr to #Race2 is 2 to 3, select r2=40, leaving 100−r2=60.

There is carryover pc1=($t/#Race1)*#Cr1/$c1=$8.10*6/$160.21=0.3033

Assume finishing order 5-1-7, see FIG. 10: Track: 14 16 13 15 15 0 16 15 16.

24'(5) earns credit $c1*r2%/(#Race2cr*p2)=$60.14 where p2=0.17765407.

25'(5) earns credit $c1*r2%/(#Race2cr*p2)=$35.03 where p2=0.30504006.

24(1) earns credit $c1*(100−r2) %/(#Race2*p2)=$19.89 where p2=53723145.

25(1) earns credit $c1*(100−r2) %/(#Race2*p2)=$16.54 where p2=64586252.

Total credit from Race 2 is $c2=$131.60. #Cr2=4.

Based on the order of top six WIN probabilities being 1-6-4-2-9-8 (see FIG. 11), bet make-up Win on {#4,#2}, Place on {#2,#9}, Show on {#9,#8}. Thus, #Race3cr=6. Since the ratio of #Race3cr to #Race3 is 2 to 3, select r3=40, leaving 100−r3=60.

There is carryover pc2=($c1/#Race2all)*#Cr2/$c2=0.32470111 with x=1/(pc1*pc2*p3).

Assume finishing order 9-2-8, see FIG. 11: Track: 15 15 0 14 16 13 0 14 13

34'(9) earns payoff [$c2*r3%/(#Race3cr*p3)]*(100−e(x)) %=$32.75, where p3=25266302 and e(x)=0.0567.

35'(9) earns payoff [$c2*r3%/(#Race3cr*p3)]*(100−e(x)) %=22.61, where p3=0.36683542 and e(x)=0.0539.

34'(2) earns payoff [$c2*r3%/(#Race3cr*p3)]*(100−e(x)) %=$.26.32, where p3=0.31565630 and e(x)=0.0549.

35(2) earns payoff [$c2*(100−r3) %/(#Race3*p3)]*(100−e(x)) %=$16.67, where p3=0.51454920 and e(x)=0.0522.

35'(8) earns payoff [$c2*r3%/(#Race3cr*p3)]*(100−e(x)) %=$26.32, where p3=0.31538767 and e(x)=0.0549.

Total final payoff $149.59, net profit $3.17.

Now, in order to see the difference of using credit or not, let us use $121.50 to do three 1-race wagering, by cashing three 1-race payoffs one after another, first with #Race2all=15 and #Race3all=15 as shown in FIG. 4B, marked by {X,+} and {X,=} respectively.

Race 1 $a=$121.50/15=$8.10.

13(3) earns payoff ($a/p)*(100−e(x)) %=$38.04 where p=0.20501718 and e(x)=3.72.

14(3) earns payoff ($a/p)*(100−e(x)) %=$21.08 where p=0.37198853 and e(x)=3.17.

15(3) earns payoff ($a/p)*(100−e(x)) %=$14.61 where p=0.53737468 and e(x)=2.96.

14(6) earns payoff ($a/p)*(100−e(x)) %=$35.02 where p=0.22269434 and e(x)=4.49.

15(6) earns payoff ($a/p)*(100−e(x)) %=$23.89 where p=0.32851860 and e(x)=3.26.

15(4) earns payoff ($a/p)*(100−e(x)) %=$22.12 where p=0.35450968 and e(x)=2.82.

Total payoff $154.76 cashed to place 15=#Race2all bets of $a=$154.76/15=$10.32

The second 1-race bet replacing 24'(5) earns payoff ($a/p)*(100−e(x)) %=$55.84 where p=0.17765407 and e(x)=3.91.

The second 1-race bet replacing 25'(5) earns payoff ($a/p)*(100−e(x)) %=$32.71 where p=0.30504006 and e(x)=3.32.

The second 1-race bet replacing 24(1) earns payoff ($a/p)*(100−e(x)) %=$18.65 where p=0.53723145 and e(x)=2.97.

The second 1-race bet replacing 25(1) earns payoff ($a/p)*(100−e(x)) %=$15.51 where p=0.64586252 and e(x)=2.89.

Total payoff $120.71 cashed to place 15=#Race3all bets of $a=$120.71/15=$8.05.

The third 1-race bet replacing 34'(9) earns payoff ($a/p)*(100−e(x)) %=$30.76 where p=0.25266302 and e(x)=3.49.

The third 1-race bet replacing 35'(9) earns payoff ($a/p)*(100−e(x)) %=$21.25 where p=0.36683542 and e(x)=3.18.

The third 1-race bet replacing 34(2) earns payoff ($a/p)*(100−e(x)) %=$24.67 where p=0.31565630 and e(x)=3.29, The third 1-race bet replacing 35(2) earns payoff ($a/p)*(100−e(x)) %=$15.18 where p=0.51454920 and e(x)=2.99.

The third 1-race bet replacing 35'(8) earns payoff ($a/p)*(100−e(x)) %=$24.69 where p=0.31538767 and e(x)=3.29.

Total final payoff $116.25, that is, net loss: $5.25.

Thus, taking advantage of credit betting results in a small profit while otherwise a small loss.

Multi-race Win/Exacta/Tricta

The multi-race Tricta-Exacta-Exacta ticket of FIG. 5A. In Race 1, based on the order of top six WIN probabilities being 1-3-9-6-2-4 (see FIG. 8A, Track: 15 16 14 15 15 14 16 15 13.), bet $0.01 1st/2nd/3rd on {#1,#3,#9,#6}, 2nd/3rd on #2 and 3rd on #4. Thus, #Race1=64. In Race 2, based on the order of top five WIN probabilities being 1-2-3-4-5 (see FIG. 10: Track: 14 16 13 15 15 0 16 15 16), bet 1st/2nd on {#1,#2,#3,#4}, 2nd on #5. Thus, #Race2=16. In Race 3, based on the order of top four WIN probabilities being 1-6-4-2 (see FIG. 11: Track: 15 15 0 14 16 13 0 14 13), bet 1st/2nd on {#1,#6,#4}, 2nd on #2. Thus, #Race3=9. In total, #Race1*#Race2*#Race3=9216 bets, $t=$92.16.

Assume finishing order 3-6-4, see FIG. 9A:

13(3)14(6)15(4) earns credit $c1=($t/#Race1)/p1=$608.61 where p1=0.00236604.

Based on the order of top seven WIN probabilities being 1-2-3-4-5-8-7 (see FIG. 10), bet Race 2 make-up 1st on {#5,#8}, 2nd on {#8,#7}, resulting in #Race2cr=20. Since the ratio of #Race2cr to #Race2 is 20 to 16, select r2=60, leaving 100−r2=40.

Assume finishing order 5-1-7, see FIG. 10A: Track: 14 16 13 15 15 0 16 15 16.

23'(5)24'(1) earns credit $c2=($c1*r2%/(#Race2cr*p2)=$784.29 where p2=0.02326949.

Based on the order of top six WIN probabilities being 1-6-4-2-9-8 (see FIG. 11), bet Race 3make-up 1st on {#2,#9}, 2nd on {#9,#8}, resulting in #Race3cr=#Race3all-#Race3=25−9=16. Since the ratio of #Race3cr to #Race3 is 16 to 9, select r3=80, leaving 100−r3=20.

Assume finishing order 9-2-8, see FIG. 11A: Track: 15 15 0 14 16 13 0 14 13.

33'(9)34'(2) earns payoff [($c2*r3%)/(#Race3cr*p3)]*(100−e(x)) %=$1109.70, where p3=0.02728753 and e(x)=22.78.

Now, in order to see the difference of using credit or not, let us start with the same $92.16, to do three 1-race bets, cashing three 1-race payoffs one after another, with #Race2all=36 for the second 1-race replacing bets, and #Race3all=25 for the third 1-race replacing bets, as shown in FIG. 5B, marked by {X,+} and {X,=} respectively.

The first 1-race Tricta $a=$92.16/64=$1.44

13(3)14(6)15(4) earns payoff ($a/p)*(100−e(x)) %=$559.46, where p=0.00236604 and e(x)=8.08.

Cash this $559.46 for 36=#Race2all 1-race Exacta $a=$559.46/36=$15.54.

The second 1-race Exacta replacing 23'(5)24'(1) earns payoff ($a/p)*(100−e(x)) %=$629.58, where p=0.02326949 and e(x)=5.73.

Cash this $629.58 for 25=#Race3all 1-race Exacta $a=$629.58/25=$25.18.

The third 1-race Exacta replacing 33'(9)34'(2) earns payoff ($a/p)*(100−e(x)) %=$871.30, where p=02728753 and e(x)=5.59.

Thus, taking advantage of credit with fortunately selecting r2=60 and r3=80 earns $1109.70−$871.30=$238.40 more than without using any credit.

A Qbasic program

Note that (100−e(x)) %*(100−e(y)) % is less than (100−e(x*y)) % only for not large {x,y}, and (100−e(x)) %*(100−e(y)) %*(100−e(z)) % is less than (100−e(x*y*z)) % only for not large {x,y,z}.

The following Qbasic program can be used to obtain the values of e(x), e(y), e(z), e(x*y), e(x*y*z), (100−e(x)) %*(100−e(y)) % and (100−e(x)) %*(100−e(y)) %*(100−e(z)) % for any specific {x,y,z} with x*y*z not larger than 10^8.

REM let z=0 if you are just interested in (100−e(x)) %*(100−e(y)) %=<(100−e(x*y)) %. Let y=z=0 if only interested in (100−e(x)) %.

```
INPUT "three numbers x, y, z such that x*y*z not larger than 10^8"; x, y, z
PRINT "x="; : PRINT LTRIM$(STR$(x))
IF 10>=x AND x>1 THEN t=2.5+x/4
IF 10^2>=x AND x>10 THEN t=4+2*(1/2+(x−10)/(9*10))
IF 10^3>=x AND x>10^2 THEN t=4+(2+1)*(2/2+(x−10^2)/(9*10^2))
IF 10^4>=x AND x>10^3 THEN t=4+(3+1)*(3/2+(x−10^3)/(9*10^3))
IF 10^5>=x AND x>10^4 THEN t=4+(4+1)*(4/2+(x−10^4)/(9*10^4))
IF 10^6>=x AND x>10^5 THEN t=4+(5+1)*(5/2+(x−10^5)/(9*10^5))
IF 10^7>=x AND x>10^6 THEN t=4+(6+1)*(6/2+(x−10^6)/(9*10^6))
IF 10^8>=x AND x>10^7 THEN t=4+(7+1)*(7/2+(x−10^7)/(9*10^7))
tt=100−t: PRINT "100−e(x)="; : PRINT USING "##.##"; tt
PRINT "y="; : PRINT LTRIM$(STR$(y))
IF 10>=y AND y>1 THEN u=2.5+y/4
IF 10^2>=y AND y>10 THEN u=4+2*(1/2+(y−10)/(9*10))
IF 10^3>=y AND y>10^2 THEN u=4+(2+1)*(2/2+(y−10^2)/(9*10^2))
IF 10^4>=y AND y>10^3 THEN u=4+(3+1)*(3/2+(y−10^3)/(9*10^3))
IF 10^5>=y AND y>10^4 THEN u=4+(4+1)*(4/2+(y−10^4)/(9*10^4))
IF 10^6>=y AND y>10^5 THEN u=4+(5+1)*(5/2+(y−10^5)/(9*10^5))
IF 10^7>=y AND y>10^6 THEN u=4+(6+1)*(6/2+(y−10^6)/(9*10^6))
IF 10^8>=y AND y>10^7 THEN u=4+(7+1)*(7/2+(y−10^7)/(9*10^7))
uu=100−u: PRINT "100−e(y)="; : PRINT USING "##.##"; uu
ttuu=tt*uu/100: PRINT "(100−e(x)) %*(100−e(y)) %="; USING "##.##"; ttuu; : PRINT "%"
xy=x*y: PRINT "x*y="; : PRINT LTRIM$(STR$(xy))
```

```
IF 10>=xy AND xy>1 THEN tu=2.5+xy/4
IF 10^2>=xy AND xy >10 THEN tu =4 +2 * (1 / 2 +(xy - 10)/(9 * 10))
IF 10^3>=xy AND xy>10^2 THEN tu=4+(2+1)*(2/2+(xy-10^2)/(9*10^2))
IF 10^4>=xy AND xy>10^3 THEN tu=4+(3+1)*(3/2+(xy-10^3)/(9*10^3))
IF 10^5>=xy AND xy>10^4 THEN tu=4+(4+1)*(4/2+(xy-10^4)/(9*10^4))
IF 10^6>=xy AND xy>10^5 THEN tu=4+(5+1)*(5/2+(xy-10^5)/(9*10^5))
IF 10^7>=xy AND xy>10^6 THEN tu=4+(6+1)*(6/2+(xy-10^6)/(9*10^6))
IF 10^8>=xy AND xy>10^7 THEN tu=4+(7+1)*(7/2+(xy-10^7)/(9*10^7))
tutu=100-tu: PRINT "100-e(x*y)="; : PRINT USING "##.##"; tutu
IF z<> 0 THEN
PRINT "z="; : PRINT LTRIM$(STR$(z))
IF 10>=z AND z>1 THEN v=2.5+z/4
IF 10^2>=z AND z>10 THEN v=4+2*(1/2+(z-10)/(9*10))
IF 10^3>=z AND z>10^2 THEN v=4+(2+1)*(2/2+(z-10^2)/(9*10^2))
IF 10^4>=z AND z>10^3 THEN v=4+(3+1)*(3/2+(z-10^3)/(9*10^3))
IF 10^5>=z AND z>10^4 THEN v=4+(4+1)*(4/2+(z-10^4)/(9*10^4))
IF 10^6>=z AND z>10^5 THEN v=4+(5+1)*(5/2+(z-10^5)/(9*10^5))
IF 10^7>=z AND z>10^6 THEN v=4+(6+1)*(6/2+(z-10^6)/(9*10^6))
IF 10^8>=z AND z>10^7 THEN v=4+(7+1)*(7/2+(z-10^7)/(9*10^7))
vv=100-v: PRINT "100-e(z)="; : PRINT USING "##.##"; vv
ttuuvv=tt*uu*vv/10000: PRINT "(100-e(x)) %*(100-e(y)) %*(100-e(z)) %="; USING "##.##"; ttuuvv; : PRINT "%"
xyz=x*y*z: PRINT "x*y*z="; : PRINT LTRIM$(STR$(xyz))
IF 10>=xyz AND xyz>1 THEN tuv=2.5+xyz/4
IF 10^2>=xyz AND xyz>10 THEN tuv=4+2*(1/2+(xyz-10)/(9*10))
IF 10^3>=xyz AND xyz>10^2 THEN tuv=4+(2+1)*(2/2+(xyz-10^2)/(9*10^2))
IF 10^4>=xyz AND xyz>10^3 THEN tuv=4+(3+1)*(3/2+(xyz-10^3)/(9*10^3))
IF 10^5>=xyz AND xyz>10^4 THEN tuv=4+(4+1)*(4/2+(xyz-10^4)/(9*10^4))
IF 10^6>=xyz AND xyz>10^5 THEN tuv=4+(5+1)*(5/2+(xyz-10^5)/(9*10^5))
IF 10^7>=xyz AND xyz>10^6 THEN tuv=4+(6+1)*(6/2+(xyz-10^6)/(9*10^6))
IF 10^8>=xyz AND xyz>10^7 THEN tuv=4+(7+1)*(7/2+(xyz-10^7)/(9*10^7))
tuvtuv=100-tuv: PRINT "100-e(x*y*z)="; : PRINT USING "##.##"; tuvtuv
END IF
```

Here are three examples out of the above program:

One: x=15.34, y=6.12 and z=102.82
e(x)=5.12, e(y)=4.03, e(z)=7.01.
(100−e(x)) %*(100−e(y)) %=91.06%. x*y=93.8808, 100−e(x*y)=93.14
(100−e(x)) %*(100−e(y)) %*(100−e(z)) %=84.67%, x*y*z=9656.579, 100−e(x*y*z)=86.15

Two: x=11.87, y=31.24, z=71.09.
e(x)=5.04, e(y)=5.07, e(z)=6.36.
(100−e(x)) %*(100−e(y)) %=89.76%. x*y=370.8188, 100−e(x*y)=92.10.
(100−e(x)) %*(100−e(y)) %*(100−e(z)) %=84.06%. x*y*z=26361.51, 100−e(x*y*z)=85.09

Three: x=205.43, y=98.27, z=13.54.
e(x)=7.35, e(y)=6.96, e(z)=5.08.
(100−e(x)) %*(100−e(y)) %=86.20%, x*y=20187.61, 100−e(x*y)=85.43
(100−e(x)) %*(100−e(y)) %*(100−e(z)) %=81.82%. x*y*z=273340.2, 100−e(x*y*z)=79.84.

CONCLUSION

The preferred embodiment described above provides an extremely low operation cost game to be easily run by an existing or future keno/lottery kind of operator. The invention in itself is not a computer game, but it takes advantage of computer like any of today's banking or trading business. Its automatic version can be easily integrated into some existing casino multi-game video machines.

The method presented here improves U.S. Pat. No.5,795,226 as follows: 1. There is no need to set up a physical racecourse. 2. Anyone can start an individual race anytime with own sets up one or more racecourses of preferred number of racers and individual track lengths. 3. A 1-race game can earn no house edged credit or house edged payoff. 4. The player can plan ahead a multi-race card intending to win big, and then have second thoughts after winning a race to trade in hanging credit for a sure reduced profit.

Using drawing devices other than dice boxes allows advancement spaces other than 1 to 6 as described here. Certainly other probability formulas will be needed. But the concept of (n,s)-sequence may still be useful to derive them.

In the above specification, players are required to set up a racecourse on a bet slip. Naturally, the game operator can also provide bet slips with already setup start spots.

Since a non pari-mutuel game's popularity depends greatly on house edge, a thoughtfully constructed house edge formula like what presented here is important. Besides, no house edge being charged till payoff encourages sophisticated players to enjoy trying to beat the house, or to hold on as long as possible, while the operator is always protected by the final house edge charge, and the cost of computerized handling is immaterial.

The invention is a game of any desired probability. Nowadays there are people everywhere interested in playing probability game without real big money gambling. So the game operator may organize prize tournaments to let them each start with a fixed imaginary bankroll and try to reach the best winning result within a given period of time.

One skill in the art understanding the step by step derivation of probability formulas in CALCULATION OF PROBABILITIES can easily do the followings: First, rolled numbers are not necessarily 1 to 6, it can be 0 to 5 or any other positive or negative integers where negative ones mean backward motion. Second, a roll is not necessarily to generate six numbers, it can be more or less. One can similarly define (n,s)-sequences, R(n,s), stand-by and winning sequences, and P(n,s) etc. Third, since Tr(i) is a variable, the maximal track length is not necessarily equal to 16. Fourth, the number of racers is not necessarily 9. If it is q instead of 9, then in A(n,i)=P(n,Tr(i))*ch(n,i) we let i goes from 1 to q instead of 1 to 9;—everywhere modulo 9 becomes modulo q-. One can similarly form Bm(n,i,j) and Cm(n,i,j,k) to calculate all kinds of probabilities for racers i, j, k finishing first, second and third. Besides, in the same art of forming Cm(n,i,j,k), one can form Dm(n,i,j,k,l), Em(n,i,j,k,l,h) etc. to calculate the probability of a racer finishing 4th, 5th, etc. so that betting can be so-called superfacta super high 5 etc. In that case a race will end after 4, 5 or more racers reach their finish lines. Fifth, multi races can be 4-race, 5-race, etc.

Thus, the scope of the invention should be determined by the appended claims and their legal equivalents, rather than by examples given.

I claim:

1. A method to operate betting race games using random numbers, and allowing players to set up individual track lengths and to select run schedules and payoffs comprising:

providing a plurality of wagering machines connected to a control center data processing computer, providing a plurality of bet slips containing one or a plurality of racecourses, on each said racecourse there are a plurality of numbered racers, each to advance on an individual track of spots with or without a fixed start spot, providing a plurality of numerals, providing one same numbered drawing device for each said numbered racer, which, whenever in action, will draw any one of said numerals equally probable at random, scheduling said numbered drawing devices to act, numbered as Draw #1, Draw #2, and so on, in general, Draw #n, in each said Draw #n, said numbered drawing devices being in action in natural order, firstly the number one, secondly the number two, and so on, till the last number, drawing activities and listings of drawn numerals being video displayed on monitors, allowing players to mark on a said track without said fixed start spot one said spot for a said racer to start, and no said spot to scratch a said racer, allowing players to mark on a said bet slip a draw interval in order to determine in which pace said Draw #n will be applied to advance said racers with a said fixed or marked start spot as many spots as said drawn numerals, allowing players to mark said bet slips to place bets comprising:

1-race credit simple bet: a selected racer will finish in the nth place or better to earn credit;

1-race payoff simple bet: a selected racer will finish in the nth place or better to earn payoff;

1-race credit exotic bet: two or more selected racers will finish in selected order to earn credit;

1-race payoff exotic bet: two or more selected racers will finish in selected order to earn payoff;

multi-race simple bet: in each race a selected racer will finish in the nth place or better to earn payoff;

multi-race exotic bet: in each race two or more selected racers will finish in selected order to earn payoff;

submitting marked said bet slips to said wagering machines for issuing bet tickets each with a said Draw #n assigned by said data processing computer to start the first advancements followed by subsequent advancements according to marked said draw intervals, determining finishing orders and winners of races on said bet tickets, providing method to derive formulas for calculating winning probabilities, calculating winner credits based on bet amounts and winning probabilities, allowing said winner credits of said 1-race credit bets to be used like cash to place bets, using said winner credit modified by house edge to calculate payoff of each said 1-race payoff bet, using said winner credit modified by house edge to calculate payoff of each said multi-race bet.

2. The method of claim 1 wherein keno bowls being used as said drawing devices.

3. The method of claim 1 and further comprising:

said multi-race bet being defined as hanging or remaining hanging if after the last race it stays or remains staying in a position to become winning, calculating hanging credit for each hanging or remaining hanging bet based on bet amount and hanging or remaining hanging probability, allowing players to select percentage of said hanging credit to place bets without additional wagering money.

4. The method of claim 3 and further comprising computerized means for displaying and marking said bet slips, and using a TIMER-function random number generator as said drawing device.

5. The method of claim 1 and further comprising:

using particular house edge functions based on winning probabilities.

6. The method of claim 5 and further comprising computerized means for displaying and marking said bet slips, and using a TIMER-function random number generator as said drawing device.

7. The method of claim 1 and further comprising computerized means for displaying and marking said bet slips, and using a TIMER-function random number generator as said drawing device.

* * * * *